US005520154A

United States Patent [19]

Heimberg et al.

[11] Patent Number: 5,520,154

[45] Date of Patent: May 28, 1996

[54] FUEL INJECTION DEVICE ACCORDING TO THE SOLID-STATE ENERGY STORAGE PRINCIPLE FOR INTERNAL COMBUSTION ENGINES

[75] Inventors: Wolfgang Heimberg, Ebersberg; Wolfram Hellmich, Munich; Franz Kogl, Kaufbeuren, all of Germany; Paul Malatinszky, Bulle, Switzerland

[73] Assignee: Ficht GmbH, Kirschseeon, Germany

[21] Appl. No.: 295,807

[22] PCT Filed: Mar. 4, 1993

[86] PCT No.: PCT/EP93/00491

§ 371 Date: Sep. 2, 1994

§ 102(e) Date: Sep. 2, 1994

[87] PCT Pub. No.: WO93/18296

PCT Pub. Date: Sep. 16, 1993

[30] Foreign Application Priority Data

Mar. 4, 1992 [DE] Germany ..... 42 06 817.7

[51] Int. Cl.[6] ..... F02M 37/04

[52] U.S. Cl. ..... 123/499; 92/84

[58] Field of Search ..... 123/497, 498, 123/499; 417/416; 92/84, DIG. 4

[56] References Cited

U.S. PATENT DOCUMENTS

| | | | |
|---|---|---|---|
| 4,150,922 | 4/1979 | Cuénoud et al. | 92/84 |
| 4,327,695 | 5/1982 | Schechter | 123/499 |
| 4,355,620 | 10/1982 | Seilly et al. | 123/499 |
| 4,709,619 | 12/1987 | Bartholomaus et al. | 92/84 |
| 4,718,386 | 1/1988 | Gieles | 123/499 |
| 4,735,185 | 4/1988 | Imoto et al. | 123/499 |
| 4,940,035 | 7/1990 | Waring | 123/497 |
| 5,080,079 | 1/1992 | Yoshida et al. | 123/498 |
| 5,437,255 | 8/1995 | Sadley et al. | 123/498 |

FOREIGN PATENT DOCUMENTS

| | | |
|---|---|---|
| 213472 | 9/1984 | Germany . |

*Primary Examiner*—Thomas N. Moulis
*Attorney, Agent, or Firm*—Jones & Askew

[57] ABSTRACT

The invention pertains to a fuel injection device operating according to the solidstate energy storage principle, whereby a rotor element carried in a pump housing of an electromagnetically driven reciprocating pump is accelerated almost without resistance, whereby the rotor element stores kinetic energy and impacts on a piston element, so that a pressure impulse is generated in the fuel contained in a closed pressure chamber before the piston element due to the fact that the stored kinetic energy of the rotor element is transferred via the piston element to the fuel in the pressure chamber and whereby the pressure impulse is used for the injection of fuel through a nozzle and whereby the rotor element is carried form-locking on the piston element and the two elements are mutually spring-mounted.

53 Claims, 14 Drawing Sheets

Figure 3:
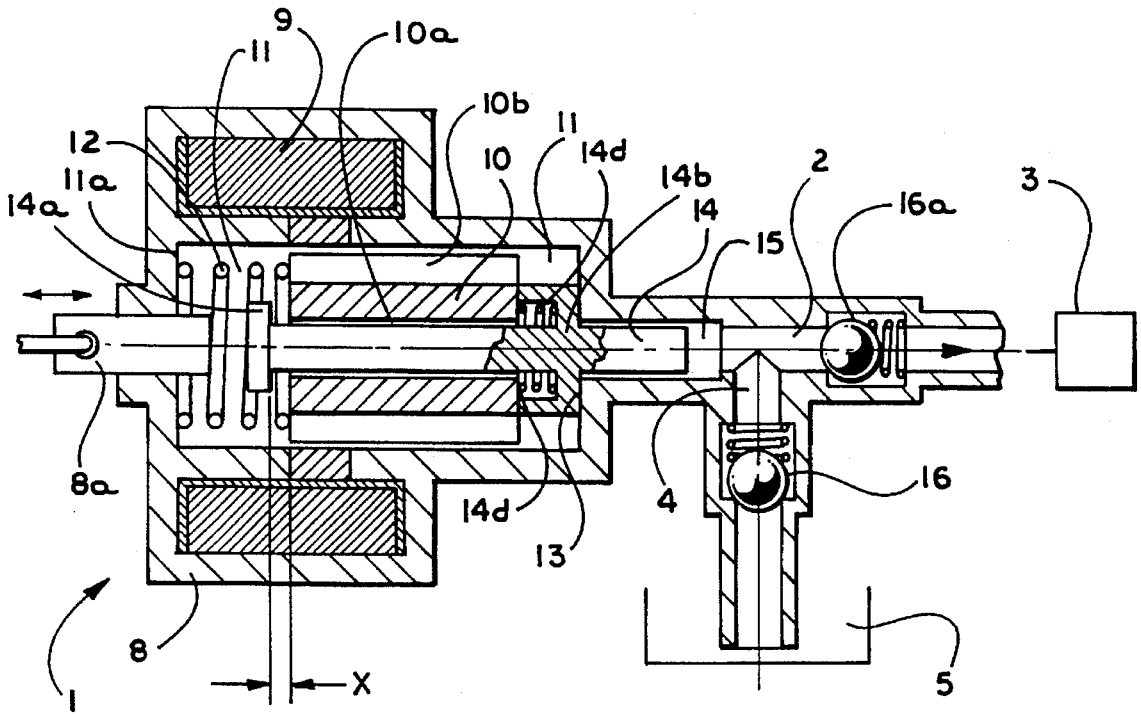

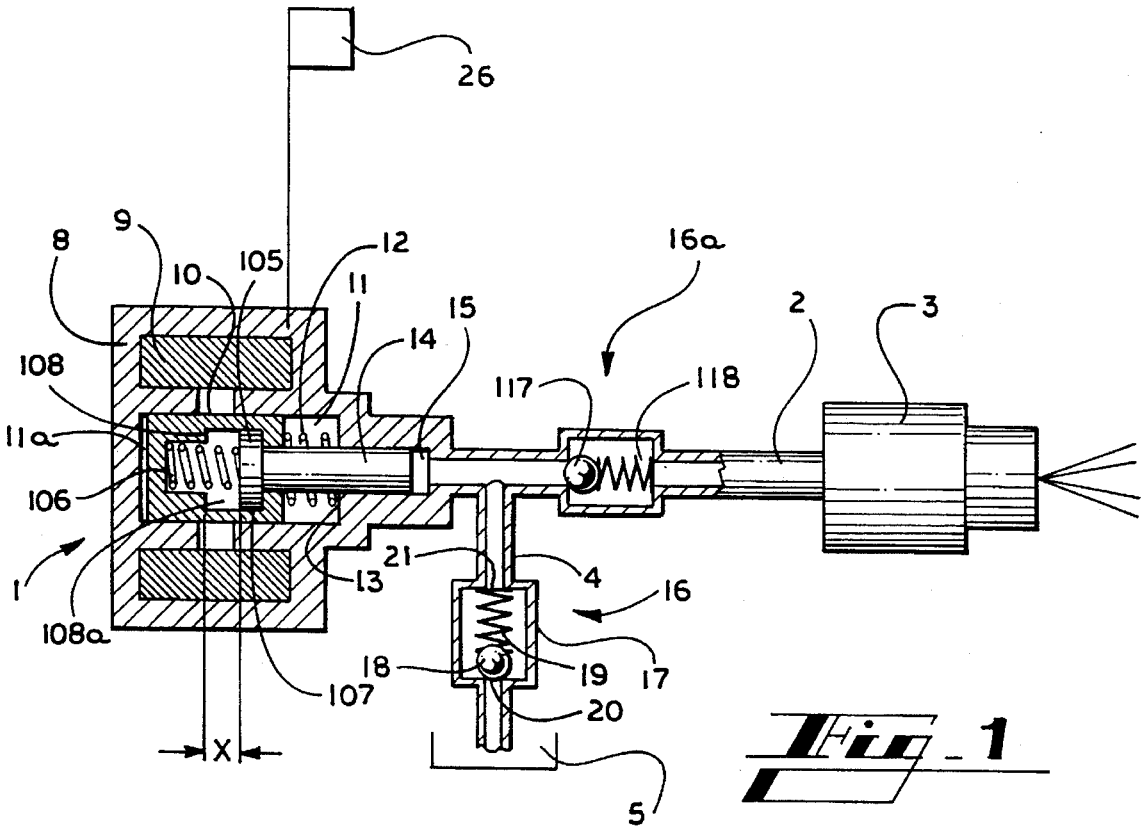
Fig. 1
Fig. 2
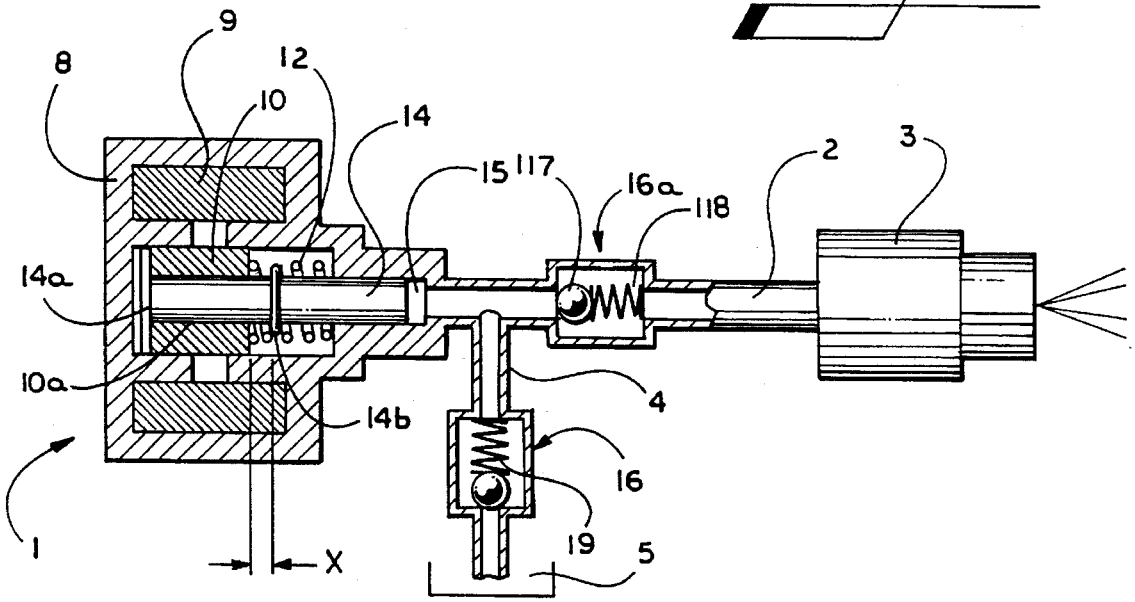

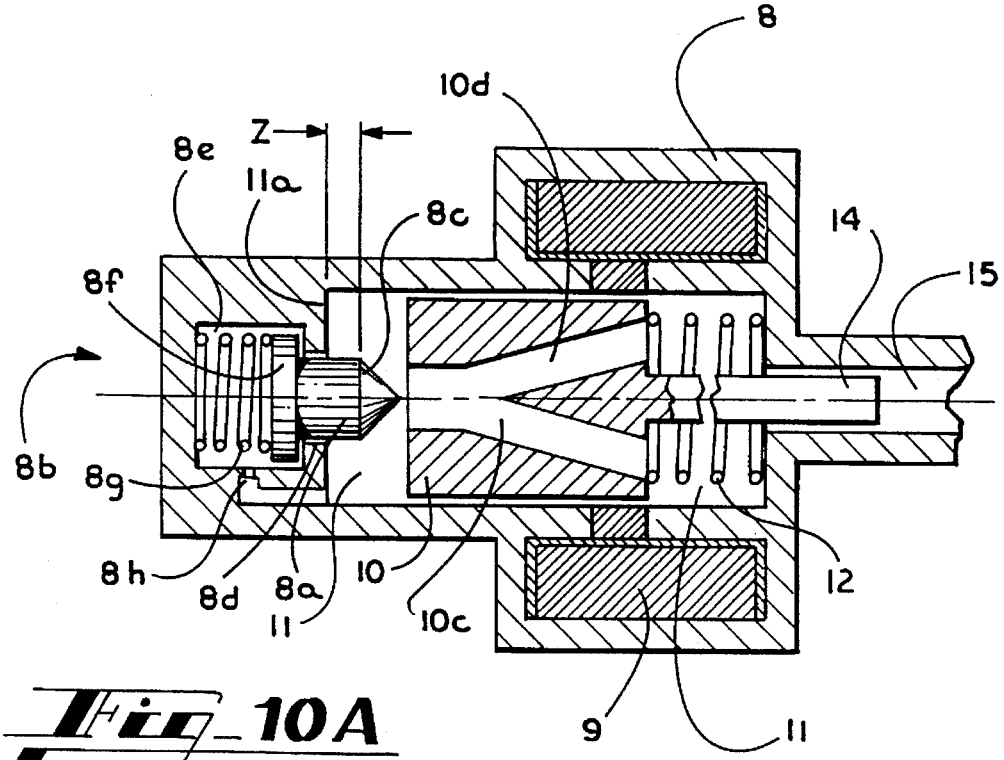
Fig_10A
Fig_10B
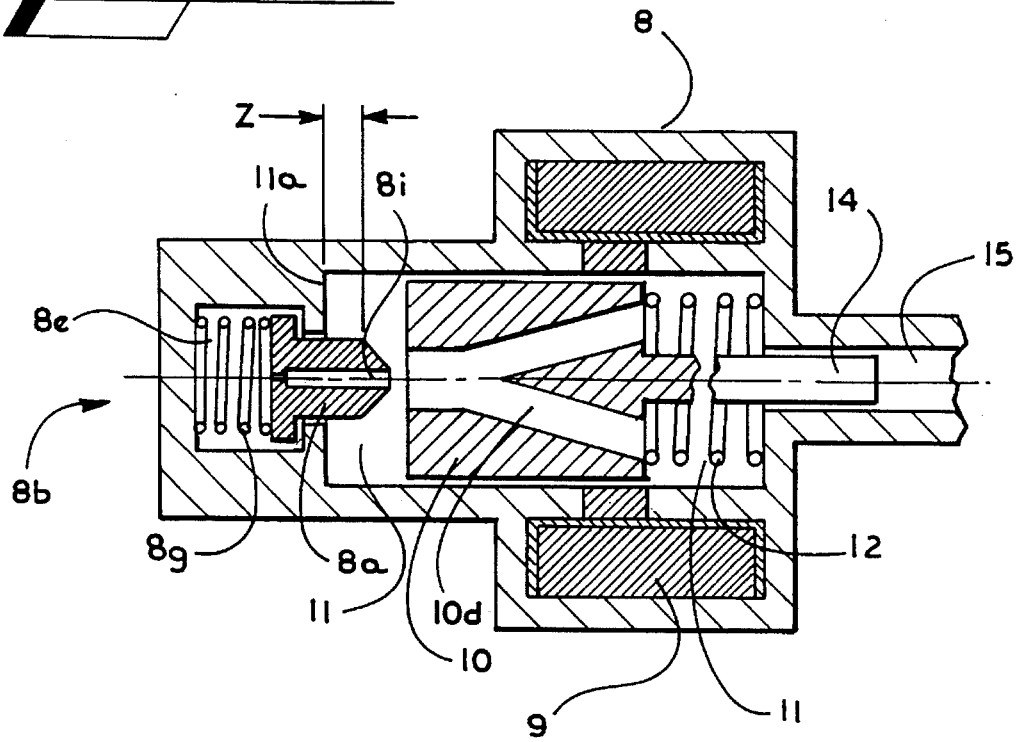

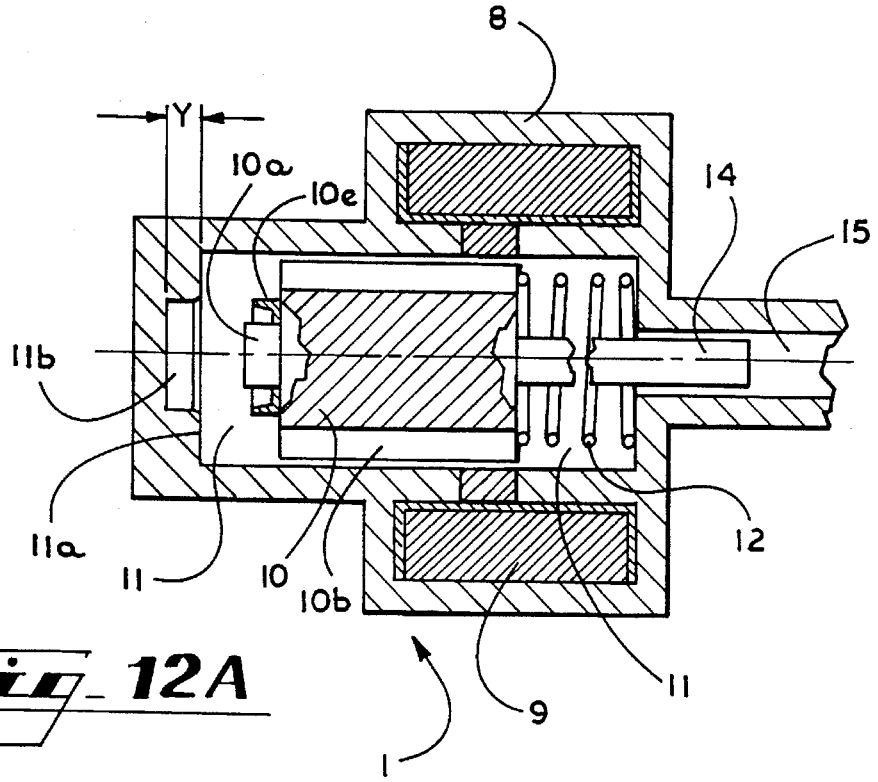
Fig. 12A
Fig. 12B
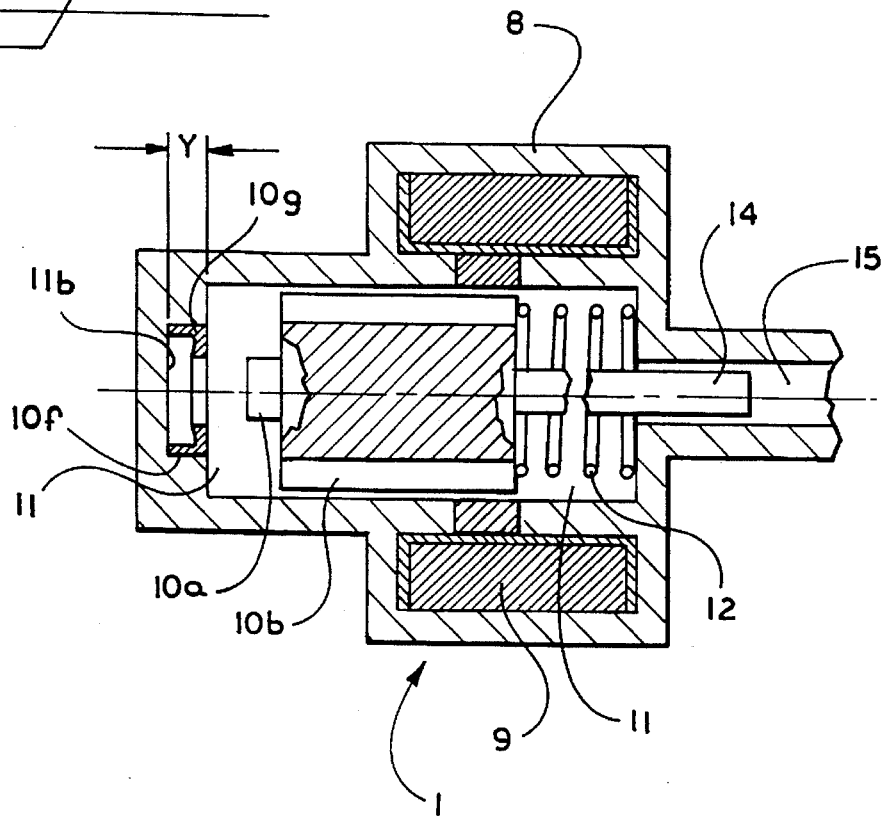

FUEL INJECTION DEVICE ACCORDING TO THE SOLID-STATE ENERGY STORAGE PRINCIPLE FOR INTERNAL COMBUSTION ENGINES

The invention pertains to a fuel injection device for internal combustion engines.

Fuel injection devices whose electrically driven reciprocating pumps work according to the so-called solid-state energy storage principle, have a delivery plunger or cylinder which on a specific path is accelerated virtually without resistance, whereby usually fuel is moved before the build-up of the delivery pressure required for the ejection of the fuel through the injection nozzle. In this way, before the pressure build-up necessary for the actual injection, kinetic energy is absorbed or stored which is then abruptly converted into a pressure rise in the fuel.

With a so-called pump-nozzle element operating on the solid-state energy storage principle known from DD-PS 120 514, the fuel delivery space accommodating the delivery plunger of the injection pump has in a first section axially parallel arranged grooves in the inner wall through which the fuel can flow off to the rear of the delivery plunger when the plunger begins to move without a significant pressure build-up in the fuel. The adjacent second section of the fuel delivery space is the actual pressure chamber which does not have grooves. When the accelerated delivery plunger enters this pressure chamber, it is abruptly slowed down by the incompressible fuel, so that the stored kinetic energy is converted into a pressure impulse which overcomes the resistance of the injection nozzle so that fuel is injected. An attendant disadvantage is that when the delivery plunger enters the second section of the delivery space, unfavorable gap conditions viz. a relatively large gap width and a relatively small gap length produce noticeably high pressure losses which particularly reduce the possible speed and pressure level of the pressure build-up and so exert an unfavorable influence on the ejection. The pressure losses are caused by flowing off of fuel from the pressure chamber into the pressure antechamber (first section of the fuel delivery space).

According to DD-PS 213 472 this disadvantage should be avoided if in the pressure chamber of the delivery plunger an impact body is arranged on which the plunger, accelerated almost without resistance, impacts, so that the pressure loss during the pressure build-up can be kept acceptably small by a relatively large gap length despite a relatively large gap width (large manufacturing tolerances) between the impact body and the inner wall of the pressure chamber. This has, however, the disadvantage that the impact leads to considerable wear of the impacting elements. Moreover, the impact sets up longitudinal oscillations in the impact body and these oscillations are transferred to the fuel and in the form of high-frequency pressure oscillations disturb the injection process.

A special disadvantage of these known solid-state energy storage injection devices is that the injection process can only be controlled to a very limited and therefore be adapted to the load conditions of the engine to a very limited extent.

The object of the invention is the creation of a cheap, simple to manufacture device for fuel injection by using an impact body of the type mentioned above with which it is possible to inject fuel without noticeable pressure losses during pressure build-up, relatively free from wear, precisely metered according to load and without oscillations having a noticeable effect on the injection process.

The object is achieved by the characteristic features disclosed and described therein. The invention is explained in more detail with the aid of drawings.

Illustrations:

FIG. 1 to 5: diagrams giving a longitudinal view of various embodiments of the injection device as per invention.

Figure 6:
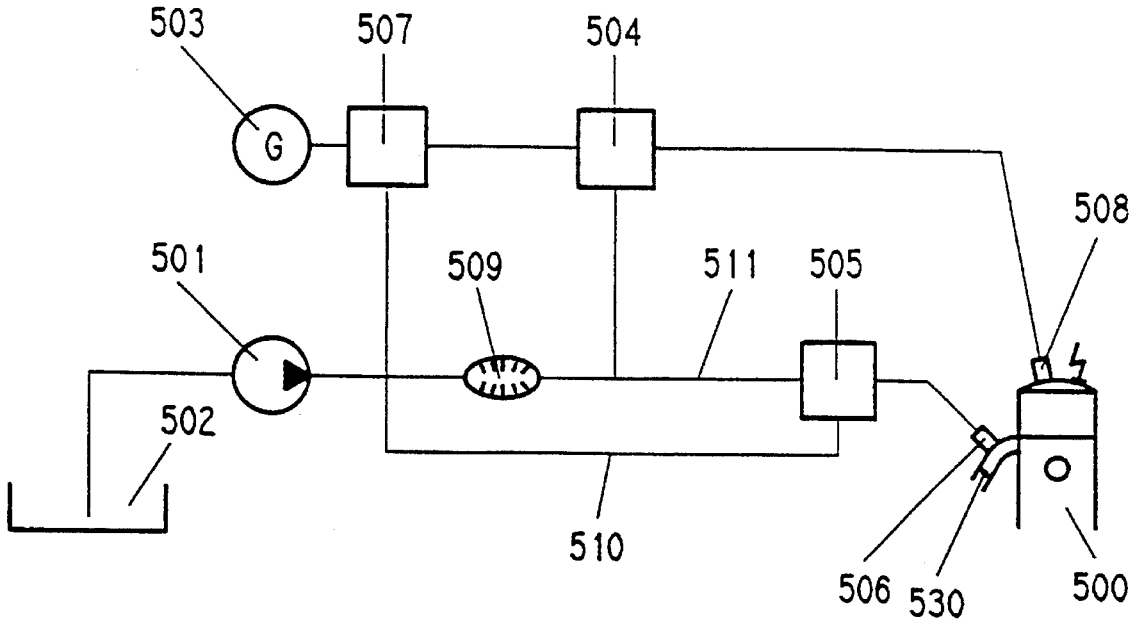
Figure 7:
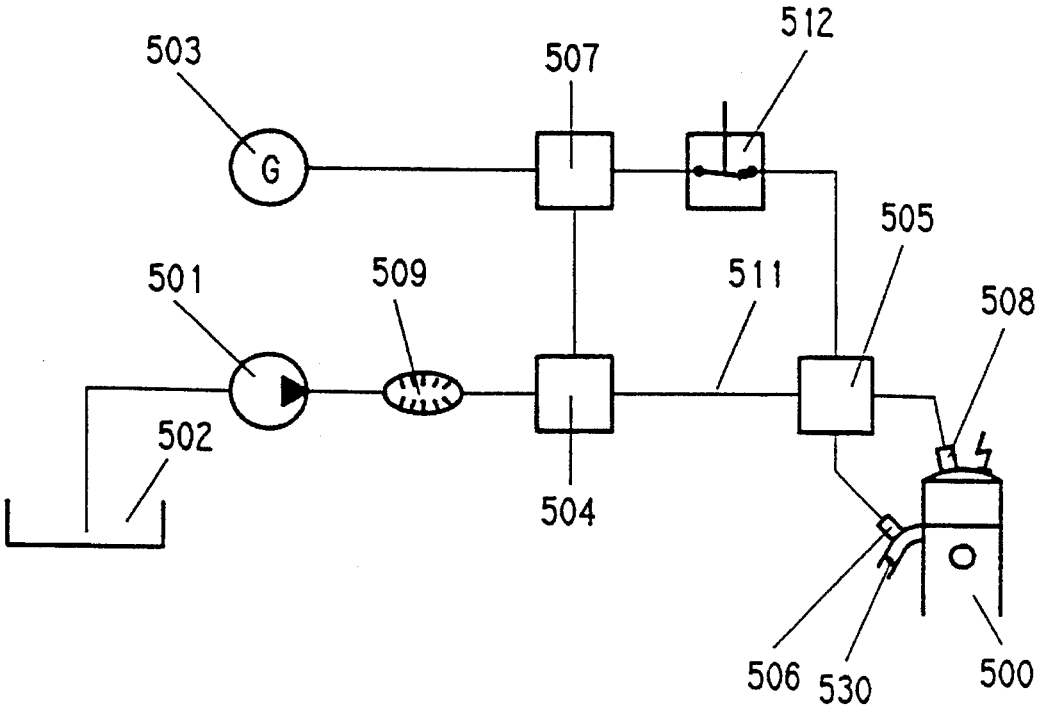
Figure 8:
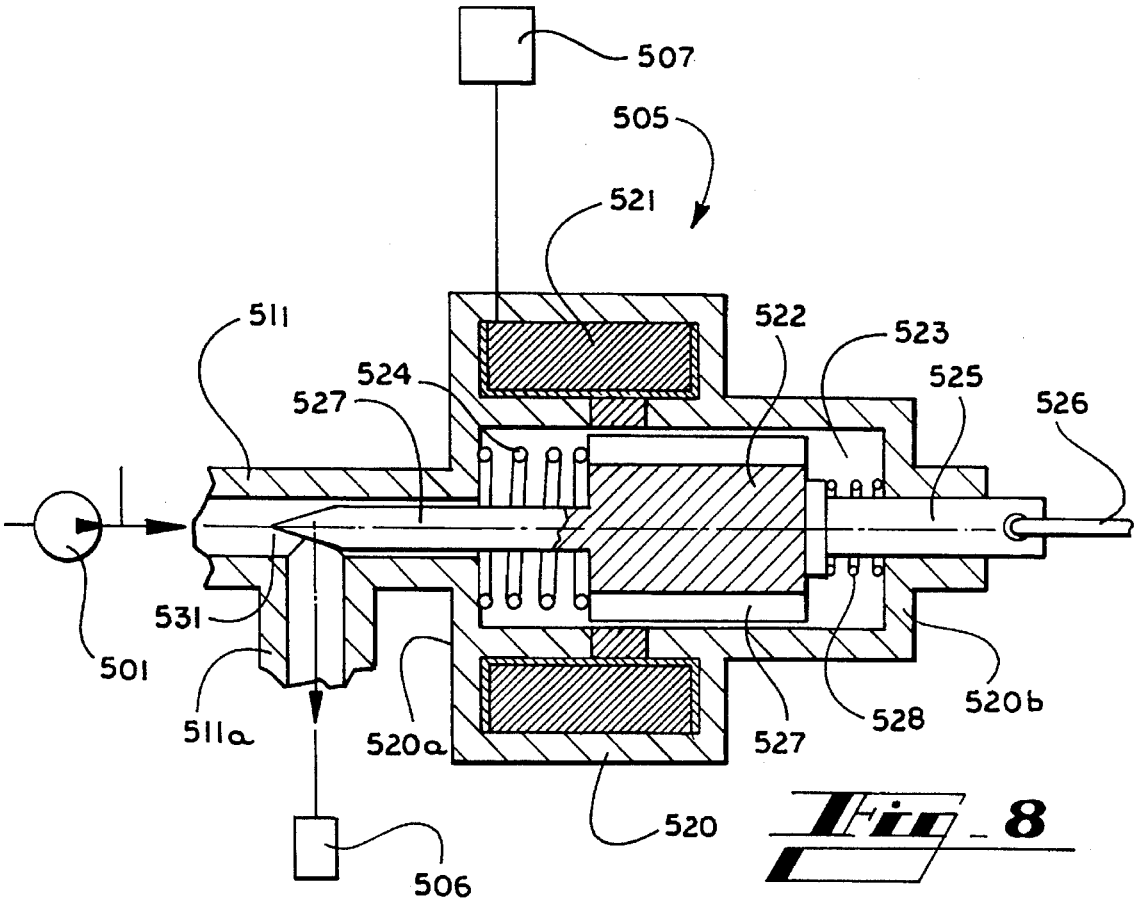

FIG. 6, 7 and 8: diagrams of a fuel supply device supporting the injection device as per invention for engine starting and emergency running without a battery.

FIG. 9 to 12: diagrams giving a longitudinal view of damping devices for the rotor of the reciprocating pump.

Figure 13:
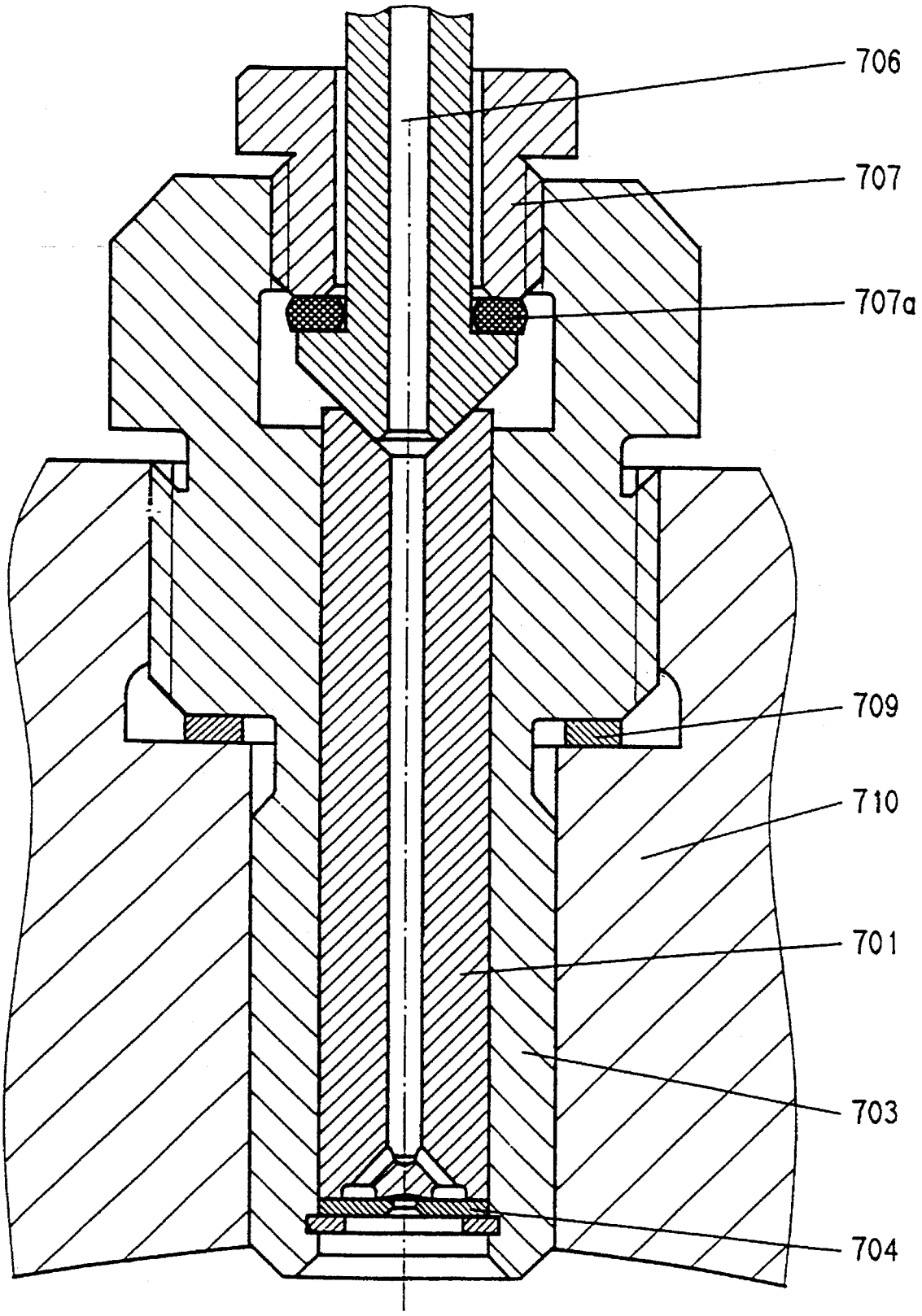
Figure 14:
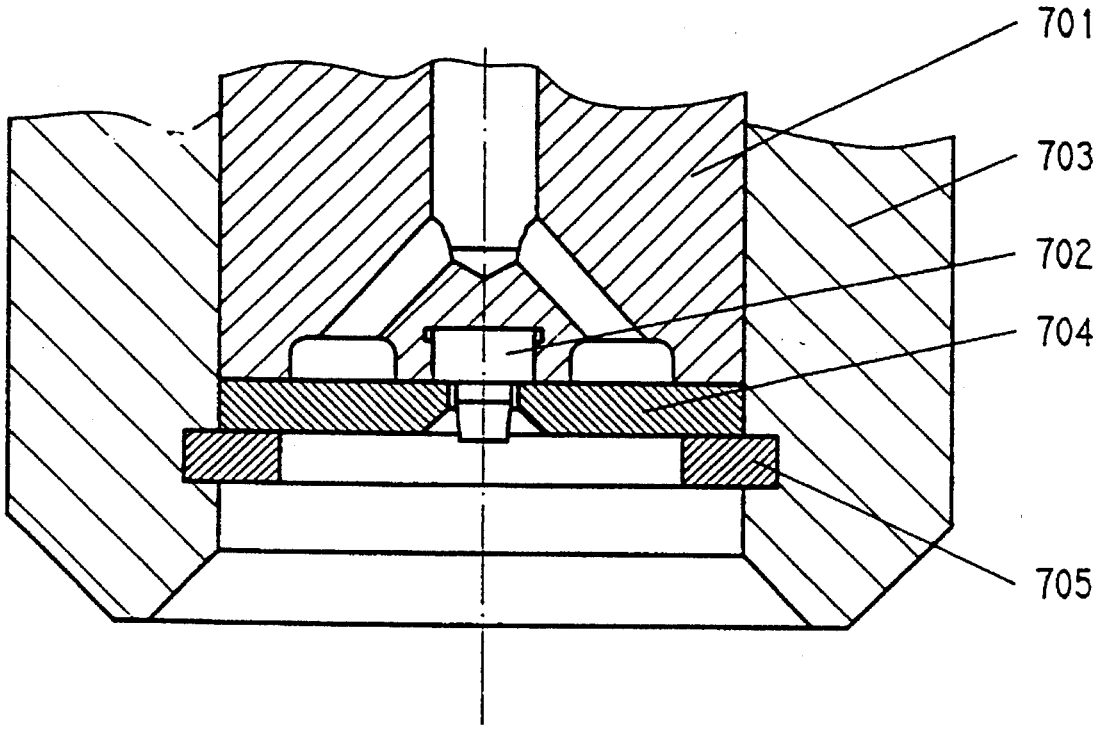
Figure 15:
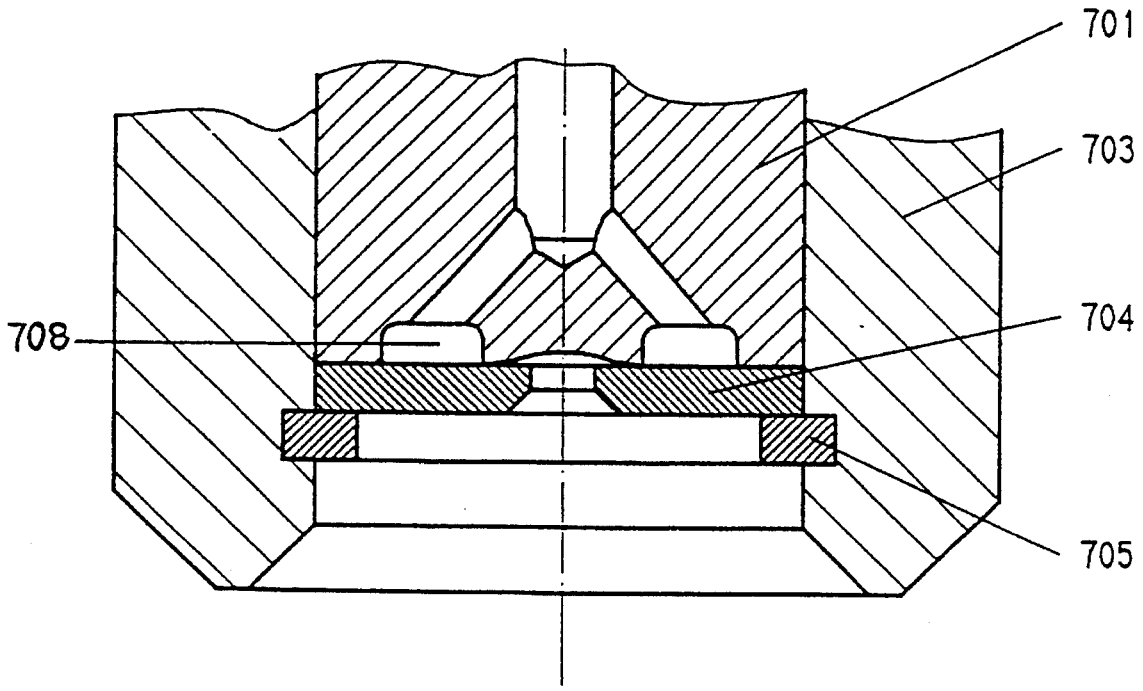

FIG. 13, 14 and 15: diagrams giving a longitudinal view of preferred embodiments of the injection valve of the injection device as per invention.

Figure 16:
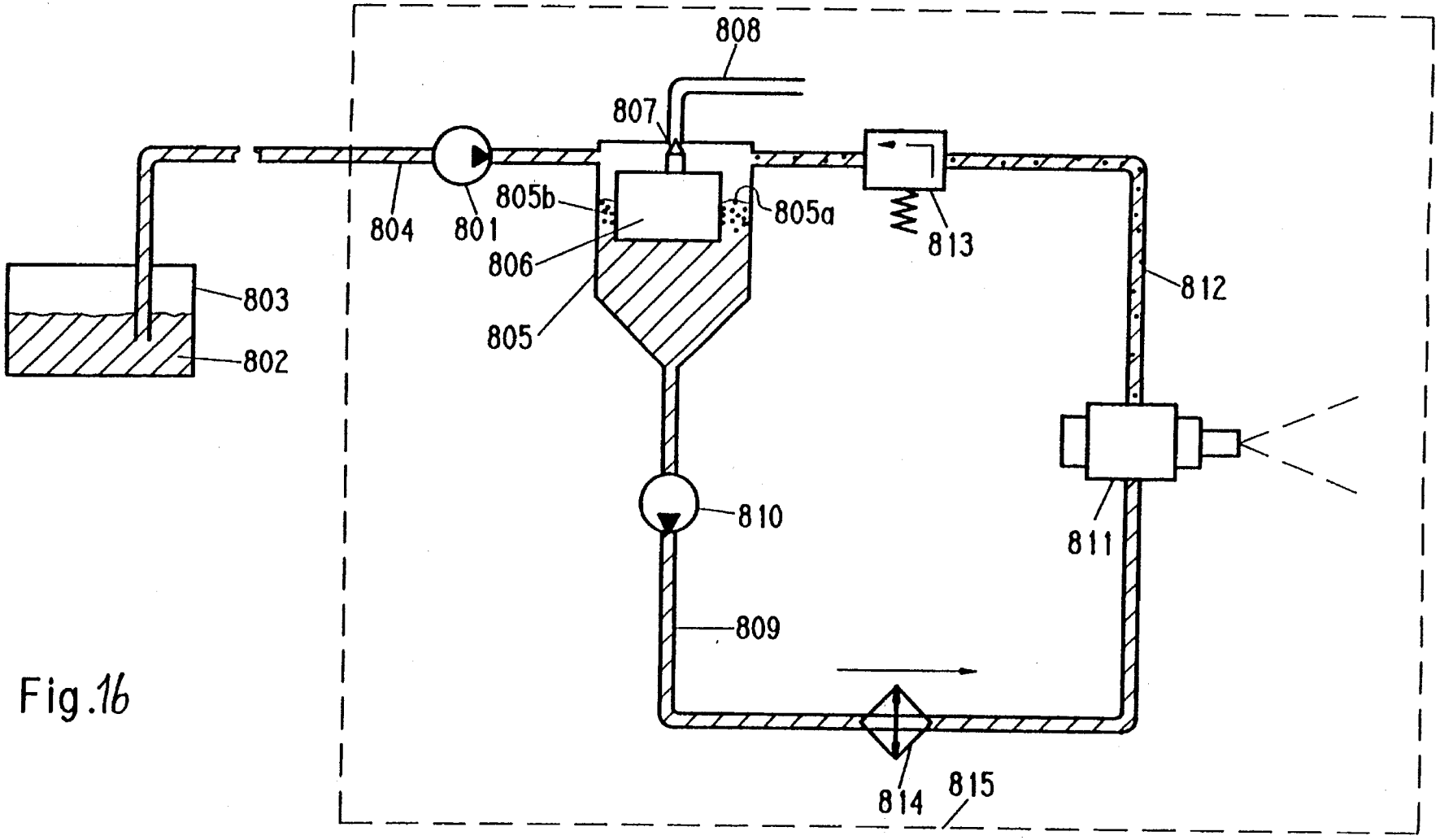
Figure 17:
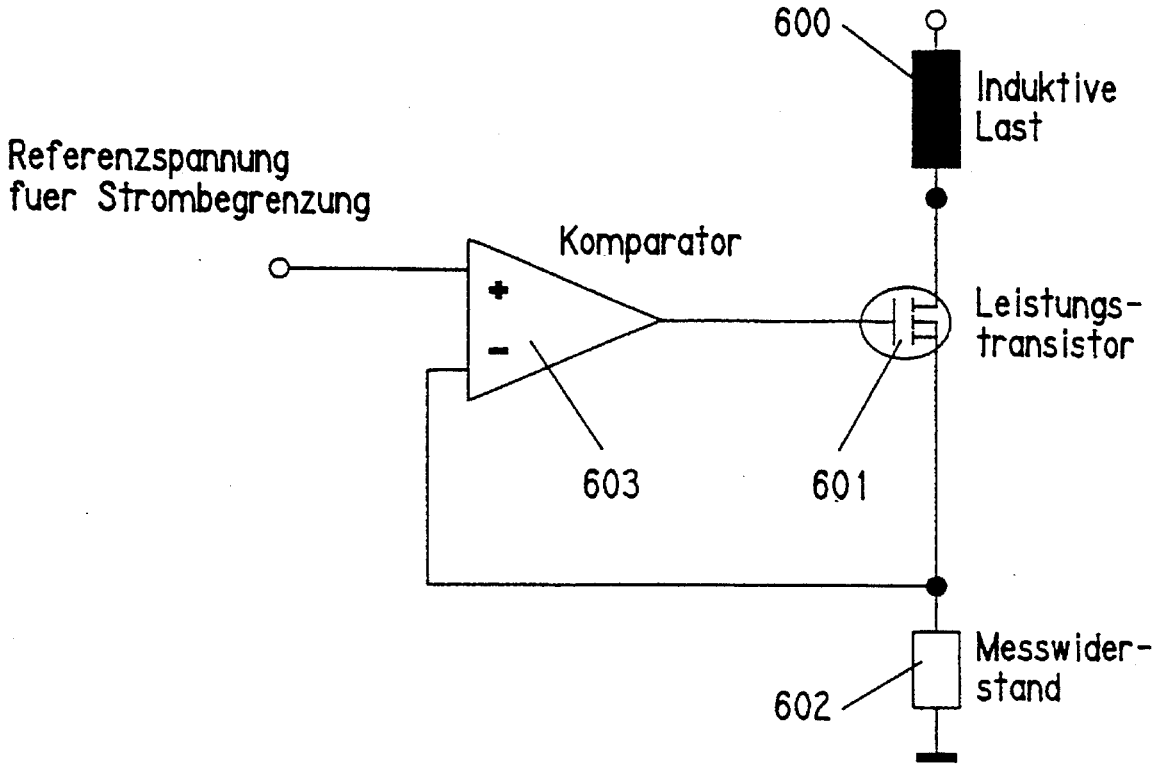

FIG. 16: diagram of a fuel supply device without a return line to the tank.

Figure 17:
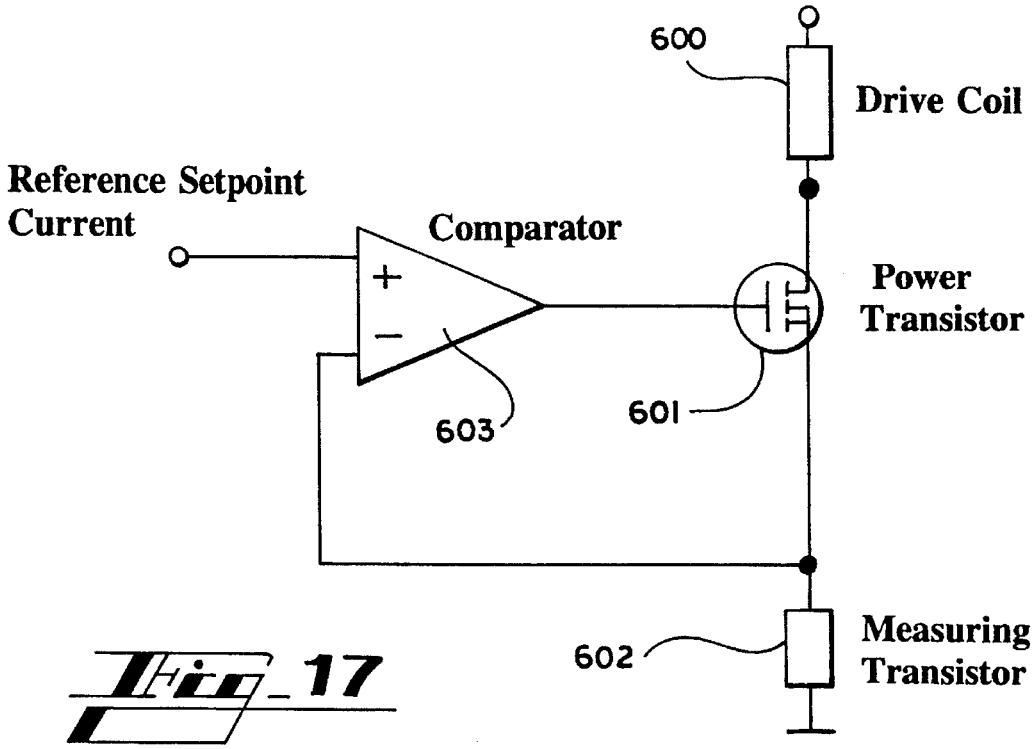

FIG. 17: diagram of a preferred circuit for triggering the coil of the injection device as per invention.

The invention proposes an initially almost resistanceless stroke section of the impact body of the injection pump, whereby if necessary a displacement of fuel takes place.

The injection device as per FIG. 1 has an electromagnetic reciprocating pump which is connected via a delivery line 2 to an injection device 3. From the delivery line 2 a suction line 4 branches off which is connected to a fuel tank 5.

The pump 1 is a reciprocating pump and has a housing 8 accommodating a magnet coil 9, and arranged near the coil passage a rotor 10 in the form of a cylindrical body, which is supported in a housing bore 11 near the central longitudinal axis of the toroid call 9 and is pressed by a pressure spring 12 into a starting position where it rests against the bottom 11*a* of the interior space 11. The pressure spring 12 is braced against the front face of the rotor 10 on the injector side and an annular step 13 of the interior space 11. The spring encircles with clearance a delivery plunger 14, connected rigidly, e.g. in one piece, to the rotor face on which the spring 12 acts. The delivery plunger penetrates a relatively long way into a cylindrical fuel delivery space 15 formed coaxially as an extension of the housing bore 11 in the pump housing 8 and is in transfer connection with the pressure line 2. Because of the depth of penetration, pressure losses during the abrupt pressure rise are avoided, whereby the manufacturing tolerances between plunger 14 and cylinder 15 may even be relatively large, e.g. need only be of the order of a hundredth of a millimeter, so that manufacturing effort is minimal.

The suction line 4 has a non-return valve 16. The housing 17 of the valve 16 may have for valve element a ball 18 which in its resting position is pressed against its valve seat 20 at the tank-side end of the valve housing 17 by a spring 19. For this purpose the spring 19 is braced on one side against the ball 18 and on the other against the wall of the housing 17 opposite the valve seat 20 near the opening 21 of the suction line 4.

The coil 9 of the pump 1 is connected to a control device 26 serving as electronic control for the injection device.

In the de-energized state of the coil 9, the rotor 10 of the pump 1 is on the bottom 11*a* through the initial tension of the spring 12. The fuel supply valve 16 is thereby closed.

When the coil 9 is triggered by the control device 26, the rotor 10 is moved against the force of the spring 12 towards the injection valve 3. The spring force of the spring is relatively weak so that the rotor 10 is accelerated virtually without resistance during the first stroke section. During the second stroke section the pressure build-up and the injection of the fuel occur, whereby the rotor 10 and the plunger 14 move jointly.

For the delivery end the coil 9 is de-energized. The rotor '10 is moved back to the bottom 11*a* by the spring 12. Simultaneously, the fuel supply valve 16 opens, so that additional fuel is sucked from the tank 5.

Advantageously, in the pressure line 2 between the injection valve 3 and the branch line 4 a valve 16*a* is arranged which maintains a static pressure in the space on the side of the injection valve, whereby this pressure is e.g. higher than the vapor pressure of the liquid at maximum operating temperature, so that the formation of bubbles is prevented. The static pressure valve may be designed like e.g. the valve 16.

The invention proposes that the delivery plunger 14 is supported axially displaceable in the rotor 10. For this purpose the rotor 10 features a stepped central longitudinal bore 108*a* like a blind bore, whereby the end of the blind bore 108*a* is of smaller diameter than a central area and forms a stopping annular step 108, whereby the delivery plunger 14 is supported in the central area by a guide ring 105 formed integrally with the plunger, this ring having a larger diameter than the delivery plunger 14 and thus adapted to the widened central part of the bore. The guide ring 105 of the delivery plunger 14 is under tension from a relatively weak pressure spring 106 which is braced at its other end against the bottom of the blind bore 108*a* in the rotor 10. In the resting position the guide ring 105 rests with its annular surface on the delivery plunger side against a circular stop face 107 of the central area by the action of the spring 106, this stop face being formed as a step between the larger-diameter central bore section and the smaller-diameter bore section with the opening traversed by the delivery plunger 14.

The fuel injection device as per FIG. 1 functions as follows. The rotor 10 is during its first stroke section accelerated virtually resistanceless due to the weak force of the spring 106, whereby the plunger 14 does not move. After covering the path length "X" the annular step 108 of the bore 108*a* impacts on the guide ring 105, so that the stored kinetic energy of the rotor 10 is suddenly and abruptly transferred to the plunger 14, which passes this energy on to the fuel in the pressure chamber 15, 2, whereby a pressure rise is effected in the fuel which leads to the ejection of fuel through the injection nozzle 3.

The injection device shown in FIG. 2 also has in the pressure line 2 a non-return valve 16*a*, whose construction is similar to that of the non-return valve 16 and is accordingly equipped with a ball-shaped valve element 117 and a return spring 118. The purpose of this non-return valve is primarily the maintenance of a static pressure in the fuel in the line between nozzle 3 and valve 16*a*, so that this pressure is e.g. higher than the vapor pressure of the liquid at maximum operating temperature.

As shown in FIG. 1, delivery plunger 14 and rotor 10 are mutually displaceable. For this purpose the rotor 10 has a through-bore 10*a* traversed by the delivery plunger 14. A circular stop 14*a* is attached to the delivery plunger 14 at the free end which protrudes rearward from the rotor 10. A further stop ring 14*b* is located in the pressure chamber 15 of the delivery plunger 14, whereby the rotor 10 is positioned on the plunger 14 between the two stop rings 14*a* and 14*b* with an interspace "X" which marks the possible acceleration stroke of the rotor 10. The rotor return spring 12 engages over the stop ring 14*b* so that it is not disturbed by the ring 14*b*.

The function of this embodiment of the injection device corresponds to that of the injection device as per FIG. 1, whereby the rotor 10 in this case drives the piston 14 via the rings 14*a* and 14*b*.

With the embodiments of the injection device described above with the aid of the FIG. 1 and 2, the delivery of the fuel to the injection nozzle is performed by electromagnetic force and the return movement of the delivery element 14 and the rotor 10 necessary inter alia for the fuel induction is effected by the spring 12. For special applications it may be advantageous to reverse this principle, i.e. to effect the delivery movement to the injection nozzle by spring force and the induction movement electromagnetically against the spring force, whereby the electromagnetic force simultaneously takes care of the renewed initial tensioning of the spring. FIG. 3 shows such a preferred embodiment of the invention-based injection device.

With regard to the system configuration the injection device in FIG. 3 is of the same design as that in FIG. 2. The injection pump 1 is connected to a pressure line 2 to the injection nozzle 3, whereby in the pressure line 2 there is a nonreturn valve 16*a* to prevent air bubbles, this valve being of the same construction as the non-return valve 16. The injection pump 1 is actuated electromagnetically. For this purpose a coil 9 is arranged in the pump housing 8 and in the interior space 11 of the housing 8 the rotor is arranged axially displaceable and has slots 10*b* extending axially parallel, via which the areas of the interior space 11 before and behind the rotor 10 communicate.

The rotor 10 is displaceable in relation to the delivery plunger 14, whereby the delivery plunger passes axially displaceable through a bore 10*a* in the rotor 10. The delivery plunger 14 has on its end away from the pressure chamber 15 the stop ring 14*a*, which as further described below forms a stop face in operative connection with a stop pin 8*a* accommodated adjustable in the housing 8 and e.g. operable by a Bowden cable. At the other end the delivery plunger 14 protrudes into the delivery cylinder 15, whereby on the part of the delivery plunger 14 in the interior space 11 there is the stop ring 14*b* which has an annular space 14*c* towards the rotor 10. In the annular space 14*c* there is a spring 14*d* which is braced 'at one end against the rotor 10 and at the other against the bottom of the annular space 14*c*.

The rear of the rotor 10 is under tension from the return spring 12, which is braced against the bottom 11*a* of the interior space 11, so that the rotor 10 pushes against the ring 14*b* and holds it against the annular step 13 on the pressure line side of the interior space 11. This defines the resting position of the delivery plunger 14 and the rotor 10. The rotor 10 is freely axially displaceable on the delivery plunger 14 by the path length "X".

When the coil 9 is excited, the rotor is first only moved against the spring 12. After the path length "X" the delivery plunger 14 is moved along with the rotor movement and the intake stroke is executed. During the intake stroke the supply valve 16 opens and the fuel flows into the pump space 2, 15. The spring 14*d* ensures that the delivery plunger 14 and the rotor 10 do not execute undesired relative motions. Depending on the intensity of the electrical energy supplied, an equilibrium of forces is established during different intake stroke path lengths between the spring 12 and the electromagnetic force. This makes it possible to control the fuel quantity to be injected through the electrical energy supplied.

If after the completed intake stroke the power supply is interrupted, the spring 12 accelerates the rotor 10 first without resistance on the path "X" towards the stop ring 14*b*. When the rotor impacts on the stop ring 14*b*, the kinetic energy of the rotor 10 is transferred to the delivery plunger 14 and from here as pressure energy to the fuel column in the delivery cylinder 15 and the attached pressure line 2. The supply valve 16 in the suction line 4 is thereby closed and the pressure maintenance or non-return valve 16*a* begins to open.

The delivery plunger 14 on its path to the possible stop 13 thereby executes the actual delivery stroke leading to the ejection of fuel through the injection nozzle 3, until the delivery plunger with the front face of its circular widening 14*b*, which face is positioned forward in the delivery direction, rests against the stop 13, so that the fuel delivery is ended.

This construction makes a timewise very short pressure shock possible, which is characterized by a defined end of the delivery. This produces considerable advantages with two-stroke engines which because of their particularly high engine speed afford only short mixing times. Additionally, this construction after slight modification is suitable for engines which do not offer a defined electrical energy supply as required for electronic control. For this purpose it is e.g. possible to excite an electromagnetic coil commonly used for simple ignition systems of small engines, once per rotation, and to supply a current impulse which in its weakest form permits exactly the full rotor stroke distance. In this case the stop 8*a* which sets the intake stroke, serves for metering, whereby the stop in the most simple case is mechanically connected for this purpose with the throttle valve of the engine.

The principle of solid-state energy storage for a fuel injection device has the considerable advantage, that the pressure rise in the pump system independent of the fuel quantity to be injected is very steep. This permits a low nozzle opening pressure, because with an open nozzle, the fuel pressure obtaining at the nozzle is always sufficient for a good atomization. This advantage is fully exploited in the embodiment of the invention-based injection device as per FIG. 4, where the delivery plunger by impacting on a nozzle pin simultaneously controls the opening and closing of the injection nozzle. Another advantage is that the level of the nozzle opening pressure and hence e.g. the wear-induced decrease of the spring force of the nozzle spring has no effect on the injected fuel quantity.

Figure 4:
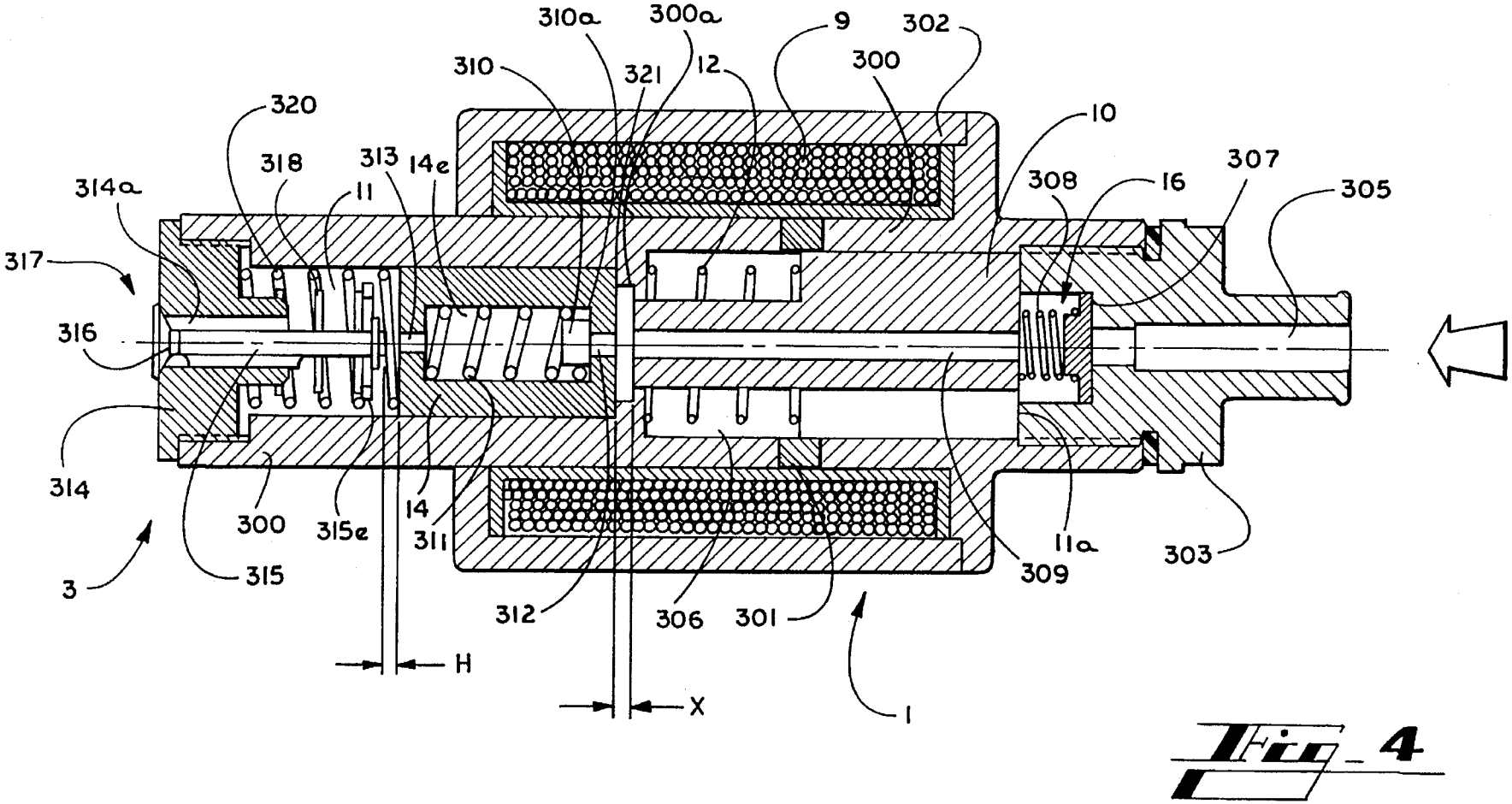

The injection device shown in FIG. 4 proposes uniform construction of the injection nozzle 3 and the injection pump 1. The common housing of the device is of multi-part design and consists of an essentially tubular inner housing cylinder 300, subdivided in one section containing the injection pump rotor, by a non-magnetic ring element, so that a force can be applied to the rotor 10 by a coil 9. The two housing parts of the housing cylinder 300 are interconnected hydraulically tight in the area of the ring element 301 and the coil 9 is mounted on the outer circumference of the housing cylinder 300, axially engaging over the ring element 301. Additionally, there is a cylindrical housing part 302 which surrounds the housing cylinder 300 and encloses the coil 9 from outside. At the tank-side end a connecting part 303 is screwed into the housing cylinder 300. The connecting part 303 has a through-bore 305, which serves as supply line for the fuel symbolized by the arrow before the bore 305.

At the other pressure-side axial end of the housing cylinder 300 the injection nozzle 3 is inserted in a thread. Between nozzle 3 and connecting part 303 is a passage with areas of different diameters in the housing cylinder 300. Adjacent to the connecting part 303 the passage has the largest diameter which forms the working space 306 for the rotor 10 of the injection pump 1. This working room 306 is limited on the tank side by a circular bottom area 11*a* which serves as stop face for the rotor 10 when this is pushed into its resting position by the spring 12. Towards the tank the bottom area 11*a* is followed by a diameter widening of the bore 305 in which the supply valve 16 is positioned which performs the function of the supply valve 16 in FIG. 1. The supply valve 16 has a disc-shaped valve element 307 which is pushed by a spring 308 against its valve seat which is formed by the annular surface between the through-bore 305 and its diameter-widened area. The spring 308 is braced at the other end against the rotor 10.

Through the rotor 10 passes a through-bore 309 aligning axially with the bore 305 of the connecting part 303. The rotor 10 has diameter-reduced area near its pressure-side end. The rotor return spring 12 is braced at the rotor against the annular surface in the stepped area between the smaller-diameter area and the larger-diameter area of the rotor 10. At the other end the spring 12 is braced against an annular surface formed in the housing cylinder 300 against a ring 300*a* projecting inwards between the larger-diameter working space 306 and the smaller-diameter pressure chamber 11 of the passage through the housing cylinder 300 following towards the nozzle 3. The diameter-reduced end area of the rotor 10 is so designed that it can pass through the ring 300*a*. In the pressure chamber 11 the delivery plunger is arranged separate from the rotor. The delivery plunger 14 is designed as a cylindrical hollow body and has a cylindrical cavity 14*e* communicating with the pressure chamber 11 throughvalve axial bores 312, 313. In the cavity 14*e* is a pressure valve consisting of a valve head 310, whereby the valve head 310 is pressed against the bore 312. The valve head 310 of the pressure valve therefore closes the inlet 312 by spring tension, whereby the valve head has peripheral recesses 310*a*.

The injection device 3 is inserted in the front face of the housing cylinder 300 and comprises a screwed-in plug-shaped body 314 with central through-bore 314*a* through which passes the push rod 315 of a valve lifter 317, whose tappet head 316 closes the outlet of the bore 314*a*. The tappet head 316 can therefore engage with a valve seat inset in the plug 314 with assistance from a spring 318, braced at one end against an inner annular face of the plug 314 and at the other against a spring washer 315*a* fixed at the end of the push rod 317 positioned inside.

The valve lifter 317 protrudes into the pressure chamber 11 of the housing cylinder 300, where the delivery plunger 14 is pushed into its resting position against the ring 300*a* by the spring 320 braced against the plug 314, where the plunger 14 with the front face opposite the rotor rests against a stop face 321 of the ring 300*a*. When the injection nozzle 3 is closed and the delivery plunger 14 is in resting position, an axial space "H" is left between the end of the push rod 317 positioned inside and the opposite face of the axially displaceable delivery plunger 14.

The injection device shown in FIG. 4 functions as follows. The rotor 10 is accelerated in the magnetic field generated by the coil 9 against the force of its return spring 12. During the acceleration stroke "X" (this is the axial distance between delivery plunger 14 and rotor 10 when both these elements are in resting position) the fuel in the pump working space 306 can flow to the rear of the rotor through the bore 309. When the rotor 10 at the end of its acceleration stroke "X" impacts on the delivery plunger 14, the fuel in the pressure chamber 11 is compressed abruptly. As a result of this pressure rise and also of the impact of the delivery plunger 14 on the push rod 315 after a stroke "H", the nozzle 3 opens and fuel is injected.

During the plunger displacement phase the supply valve 16 at the rear of the rotor opens and new fuel is sucked from the fuel tank (not shown).

At the end of the injection process the delivery plunger 14 is moved back against its rotor-side stop 321 by its return spring 320. Simultaneously, the nozzle pin 317 closes through its tappet head 316 the nozzle bore. During the return movement of the delivery plunger 14 the pressure valve 310, 311 accommodated in it, opens and new fuel flows from the rotor space 306 into the accommodated in it, opens and new fuel flows from the rotor space pressure chamber 11.

Figure 5:
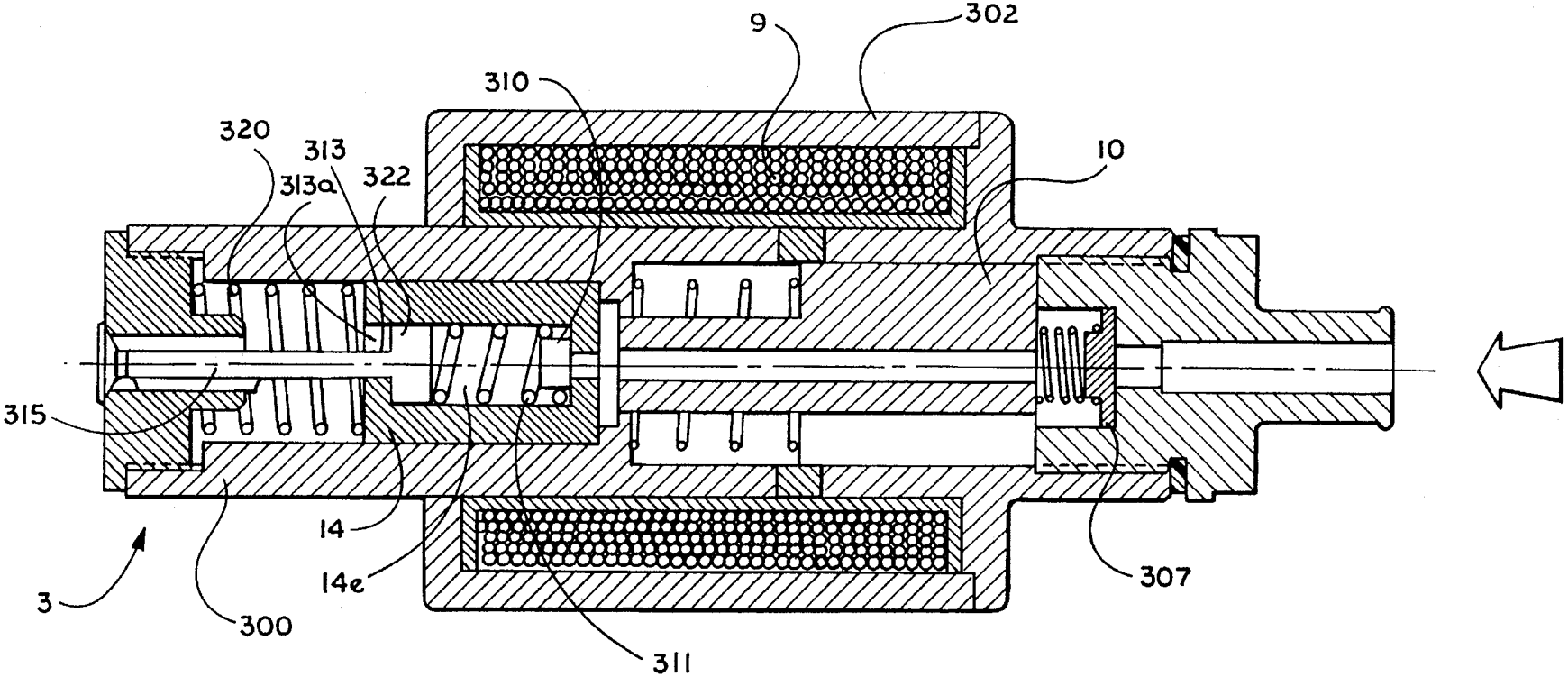

A slightly modified version of the injection device in FIG. 4 is shown in FIG. 5, whereby generally only those reference numbers have been inserted which are relevant to the modification or connected with it. The modification consist in the fact that the push rod 315 also passes through the bore 313 and protrudes into the interior space 14*e* of the delivery plunger 14, whereby at the end of the push rod 315 there is a ring 322 which forms a support for the spring 311 of the pressure valve 311, 310 in the space 14*e*. In the bore 313 peripheral slots 313*a* have been provided to allow fuel to flow through.

With this embodiment of the invention the return spring for the tappet valve 318 is absent. The opening of the nozzle 3 against the inertia of the nozzle pin 317 by the pressure in the fuel and the spring force of the spring 311 happens at the initial movement of the delivery plunger 14. For the rest the function of the device is identical to that in FIG. 4.

The injection device as per invention enables engine start or engine emergency running without a battery. This possibility is described in more detail below with the aid of FIG. 6, 7 and 8.

Electrically driven or electronically-controlled injection requires sufficient electrical energy for starting and running. In the case that sufficient electrical energy is not available, the invention proposes the possibility of starting engines with injection as per the invention even without electrical energy, for instance through manual cranking. The required fuel is made available by an auxiliary device as explained more fully below. When the engine reaches a speed at which the generator produces sufficient energy, the auxiliary device is switched off as per the invention and the injection reverts to the normal electrical or electronic mode.

There are engines that can be started without electrical energy, e.g. by a manual or kickstart device. Among these are small engines of hand tools, two-wheeled vehicles or speedboats. This starting device is necessary, because there is no battery for starting and/or running. Engines should in any case be startable even without a battery, e.g. in the case of a flat battery.

The starting of engines without electrical energy by means of an auxiliary device is achieved according to the invention by utilizing the fuel supply arrangement available on every engine at starting speed, e.g. the feed height or the pressure of the fuel pump. The fuel is thereby fed directly to the suction pipe or the intake ports in two-stroke engines or to a metering device. When the engine reaches a speed at which the generator delivers sufficient energy for the injection device, a valve blocks the direct fuel supply to the engine, the fuel fed to the injection device and this then takes over the fuel supply to the engine.

FIG. 6 shows an arrangement for the fuel supply of an engine 500 as per the invention. This includes a branching of the fuel supply line to the engine after a fuel precompression pump 501 connected on the inlet side with a fuel reservoir 502. In deenergized condition, an injection device 504 constructed according to one of the foregoing embodiments and connected to a generator 503, is inactive and a control valve 505 which is e.g. operated electromagnetically, is open for the fuel supply to an atomizer 506 on the engine 500.

When the engine 500 is started, the fuel pressure delivered by the precompression pump 501 is supplied via the open control valve 505 to the atomizer 506 on the engine 500. The flow resistance of the control valve 505 and/or the atomizer 506 is so determined that with the pressure delivered by the precompression pump 501 at engine starting speed, the fuel requirement for starting is covered. When the generator 503 coupled to the engine reaches a speed at which the energy requirement of the injection device is covered, an injection control 507, also fed by the generator 503 and connected by a control line to the injection device 540, becomes active. Additionally, the control valve 505 is closed by means of a current signal so that no more fuel can be supplied direct to the engine. Simultaneously, the injection device 504, controlled by the injection control 507, takes over the injection through the injection nozzle 508.

A hand pump found on many engines can if necessary be used as well during starting for the direct fuel supply via the atomizer 506 to the engine. The hand pump is arranged in the connection line 511 from the pump 501 to the control valve 505. The control valve is triggered by the injection control 507 via a control line 510.

FIG. 7 shows a variation of the arrangement as per FIG. 6, whereby the control valve 505 is arranged in the injection line 511 between the injection device 504 and the injection nozzle 508. The function of currentless starting is identical to the function explained above on the basis of FIG. 6.

To ensure the fuel flow through the injection device 504 without pump support, the flow resistance of the injection device 504 is kept low. It is thereby advantageous that the venting of the injection device 504 and the injection line 511 is possible without problems. If the injection device 504 must be vented, the control valve 505 is de-energized via a cutout 512 in the line from the injection control 507 to the control valve 505, insofar as this has not already been done by the injection control 507. This opens the control valve 505 towards the atomizer 506 and the air in the system can escape during simultaneous pumping, e.g. with the precompression pump 501 or the hand pump 509.

Based on FIG. 8 there now follows a detailed description of emergency running without a battery in accordance with the invention.

The arrangement shown in FIG. 6 and 7 can also be used for emergency running, when e.g. there is not sufficient energy available for the injection control and the injection device due to generator failure. The invention proposes a variation in the fuel quantity by means of a metering device, e.g. an adjustable throttle in the control valve coupled to the throttle valve in the air intake, so that temporary control of the engine load is possible.

FIG. 8 shows an embodiment of the control valve or the metering valve 505 as per FIG. 6 and 7 suitable for this purpose. The control valve 505 has a housing 520 containing a coil 521 serving to drive a rotor 522 which is supported slidable in a bore 523 of the housing 520 and is in its resting position pushed against an adjustable stop 525 arranged in the housing 520 by a return spring 524, while outside the housing a cable pull 526 is connected to the stop. The rotor 522 has peripheral longitudinal slots 527 which allow communication of fuel in the bore 523 between the front and back of the rotor 522. The bulbshaped stop 525 passes through the housing front wall 520*b* and is pretensioned in the housing 520 in relation to the housing front wall 520*b* by a spring 528.

The embodiment also involves a metering piston 527 of uniform construction with the front face of the rotor 522 opposite the stop 525. This front face is also tensioned by the return spring 524, which is braced at the other end against the front wall 520*a* of the housing 520. The metering piston 527 protrudes with a tapered tip into the delivery 511 from which moreover a connection line 511 a branches off to the atomizer 506.

The cable pull 526 connected to the stop 525 which is pretensioned by a spring against the rotor 522, is connected to the throttle valve 530 (see FIG. 7, 8). The throttle valve position is therefore directly transferred to the stop 525.

The function of the control valve 505 is as follows. In the de-excited state of the coil 521, rotor 522 and metering piston 527 are held against the stop 525 by the return spring 524. The fuel coming from the delivery pump 501 can flow through the delivery line 511 to the atomizer 506. If the control valve 505 is excited by the control device, the rotor 522 pushes the metering piston 527 against the force of the spring 524 in the delivery direction until the supply cross-section 531 of the delivery line 511 is closed.

If in an emergency the engine is run without injection, the control valve 505 is currentless and the supply cross-section 531 in the line 511 to the atomizer is therefore released. Depending on the throttle valve position, the conical metering piston 527 is pushed to a varying depth via the rotor 522 through the stop 525 into the bore of the supply cross-section. The coupling to the throttle valve 530 is thereby so selected that as the throttle valve 530 opens wider, the cross-section 531 is opened further. In the idling position of the throttle valve 530 a minimum gap remains at the cross-section 531, which allows the fuel idling quantity to pass through to the atomizer 506.

The resetting of the rotor of the injection pump is usually effected by means of the return spring fitted for this purpose. To reach high injection frequencies, the reset time of the rotor must be kept small. This can be realized e.g. by a correspondingly high spring force of the return spring. However, as the reset time becomes smaller, the impact speed of the rotor against the rotor stop increases. A disadvantage of this can be the resulting wear and/or the rebounding of the rotor at the rotor stop, so that the duration of the whole operating cycle is increased. One of the objects of the invention therefore is to keep the fall time of the rotor until resting position small, The invention proposes to meet this object by e.g. a hydraulic damping of the rotor return movement in the last part of this movement.

Figure 9:
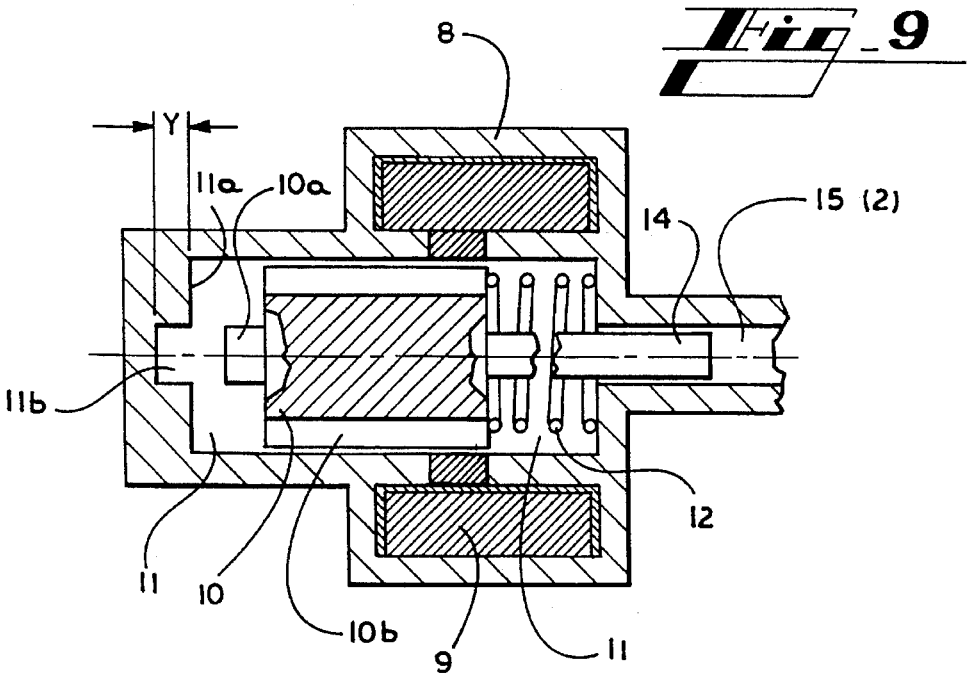

FIG. 9 shows an embodiment of the injection pump which is essentially of the same construction as that of the injection pump 1 as per FIG. 1. For the hydraulic damping there is an arrangement as is found on piston cylinders, consisting of a central cylindrical projection 10*a*, whereby this projection in the last section of the rotor return movement fits and enters a blind cylinder bore 11*b* in the bottom 11*a*, which bore is in the stop face 11*a* for the rotor 10 in the housing 8. In the rotor 10 are longitudinal slots 10*b* connecting the space 11 at the rear of the rotor with the space 11 at the front of the rotor. In the space 11 is a medium e.g. air of fuel which during the movement of the rotor can flow through the slots 10*b*. The depth of the blind cylinder bore 11*b* agrees approximately with the length of the projection 10*a* (dimension Y in FIG. 12). Because the projection 10*a* can enter the blind cylinder bore 11*b*, the rotor return movement in the last section is considerably retarded so that the desired hydraulic damping of the rotor return movement is achieved.

FIG. 10*a* shows a variant of the hydraulic damping. In this embodiment too, the pump space before the rotor 11 traversed by the delivery plunger 14 is connected before the piston 10 with the space 11 adjoining the rear of the rotor i.e. by means of bores 10*d*, which run into a central transfer passage 10*c* near the rear of the rotor. A central pin 8*a* of a shock absorber 8*b* projects with its cone point 8*c* towards the opening of the transfer passage 10*c*, passes rearward through a hole 8*d* in bottom 11*a*, which lead into a central transfer passage 10*c* near the rear of the rotor. A central pin 8*a* of a shock absorber 8*b* projects with its cone point 8*c* towards the opening of the transfer passage 10*c*, passes rearward through a hole 8*d* in bottom 11*a*, which leads into a damping chamber 8*e* and ends in the damping chamber with a ring 8*f* which has a larger diameter than the hole 8*d*. A spring 8*g* braced against the bottom of the damping chamber presses against the ring 8*f* and therefore the pin 8*a* in its resting position (FIG. 10*a*). A passage 8*h* connects the damping space 8*e* with the rearmost rotor space 11. The passages 10*c* and 10*d* afford the rotor 10 an almost resistanceless movement during the acceleration phase.

The damping device 8*b* remains inoperative during the acceleration movement of the rotor 10, so that the stroke phase is not adversely affected during the return movement the opening of the transfer passage alights on the cone point 8*c* and is closed, so that the flow through the passages 10*c* and 10*d* is interrupted. The rotor 10 presses the pin 8*a* against the spring force and against the medium in space 8*e* which is also in space 11 and flows out through the passage 8*h* into space 11. The flows are selected in such a way that optimum damping is ensured.

As FIG. 10*b* shows, it is also possible instead of the passage 8*h* to arrange a displacement bore 8*i* centrally in the pin 8*a* through which the damping medium can be pressed into the transfer passage 10*c*.

Figure 11:
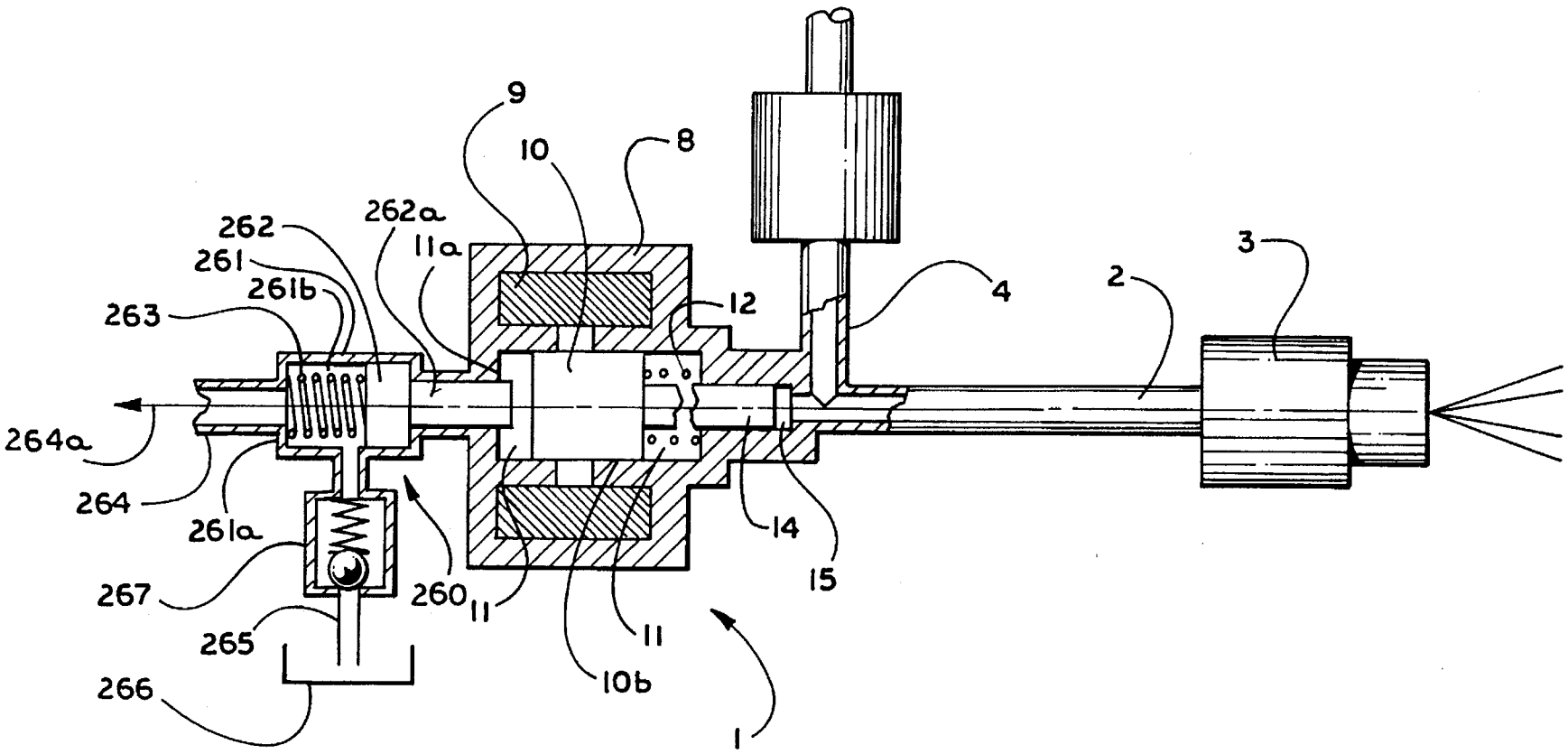

In accordance with a further advantageous development of the injection device as per the invention, it is proposed to profitably use the energy stored in the return spring 12 of the rotor during the return movement of the rotor 10. In accordance with the invention this can e.g. be achieved when the rotor on its return operates a pump device which can be used for the fuel supply of the injection device in order to stabilize the system and also to prevent the formation of bubbles or as a separate oil pump for engine lubrication. FIG. 11 shows such an embodiment of an oil pump 260 connected to the fuel injection pump 1.

The fuel injection device shown in FIG. 11 is for the rest identical to the one in FIG. 4 and therefore has a fuel supply and discharge control element for the control of the first stroke section of the delivery plunger 14. The oil pump 260 is connected to the rearward bottom 11*a* of the pump housing 8. In particular the oil pump 260 comprises a housing 261 which is connected with the housing 8 of the injection pump and in the pump space 261*b* of which housing a pump piston 262 is arranged whose piston rod 262*a* protrudes into the working space 11 of the rotor 10, whereby the piston 262 is under tension from a return spring 263 which is braced against the housing bottom 261 near an outlet 264.

Moreover, the pump space 261*b* of the housing communicates via an oil supply line 265 with an oil reservoir 266. In the oil supply line is a non-return valve 267 of similar construction to that of the valve 16 in FIG. 1.

The oil pump 260 functions as follows. When the rotor 10 of the injection pump is moved towards the injection nozzle 3 during its working stroke, the pump space 11 in the housing 8 behind the rotor 10 is increased in relation to its volume, so that the oil pump piston 262 is moved towards the rotor 10 and is finally transferred to its resting position through the action of the return spring 263. During this process oil is drawn from the reservoir 266 via the valve 267 into the working space 261*b* of the oil pump 260. During the return movement of the rotor 10 of the pump 1 towards its stop 11*a*, the oil pump piston 262 is pushed on at least part of the return path of the rotor 10 into the oil pump space 261*b*. Thereby the valve 267 is closed by the pump pressure and oil is delivered by the oil pump via the outlet 264 in the direction of the arrow 264*a* and pressed to the engine locations to be supplied with oil.

The oil pump 260 can alternatively also be used as a fuel precompression pump, whereby the fuel can be supplied to the valve device 70. This offers the advantage that the pump, 260 can generate a static pressure in the fuel supply system which inhibits the formation of bubbles e.g. when the whole system heats up.

Furthermore, the invention-based construction of the additional pump 260 on the pump 1 causes rapid damping of the rotor 10 so that the rotor does not rebound at the stop 11*a*.

FIG. 12*a* and 12*b* show a particularly effective and simple damping device. The construction of the pump device 1 is similar to that in FIG. 9. The blind cylinder bore 11*b* as per FIG. 12*a* has a larger diameter than the diameter of the cylindrical projection 10*a*. The projection 10*a* is surrounded by a circular sealing lip 10*e* of an elastic material projecting towards the blind cylinder bore, this circular lip fitting in the blind cylinder bore 11*b*. An inlet inclination at the opening of the blind cylinder bore 11*b* facilitates the entry of the lips of the circular sealing lip 10*e* into the blind cylinder bore 11*b*. This damping device provides good damping at the impact of the rotor 10 and does not impede the acceleration stroke of the rotor. The elastic damping element 10*e* with axial parallel spreading sealing lips is positive-locking as it enters the blind cylinder bore 11*b* during the return stroke of the rotor 10 and comes to rest against and provides an outward seal for the inner wall of the blind cylinder bore 11*b*.

The blind cylinder bore 11*b* as per FIG. 12*b* likewise has a larger diameter than the cylindrical projection 10*a*. A sealing ring 10*f* of elastic material is positioned with positive fit on the wall of the blind cylinder bore 11*b* and, near the opening has seal lips 10*g* directed inwards. The cylindrical projection 10*a* enters the elastic sealing element 10*f* like a piston, whereby as a result of the outflowing damping medium, the seal lips 10*g* are pressed against the cylindrical projection 10*a* so that particularly good damping of the rotor 10 is achieved.

FIG. 13, 14 and 15 show particularly advantageous embodiments of the injection nozzle (e.g. nozzle 3) for the invention-based injection device.

This injection nozzle comprises a valve seat pipe 701 against whose free lower end the diaphragm 704 is arranged, if required a jet-forming plug insert 702 (positioned in a central perforation of the diaphragm 704), a nozzle holder 703, a diaphragm plate 704 pretensioned towards the valve seat, a spring ring 705, a pressure line 706, leading on the valve seat side into a ring channel 708 open towards the diaphragm 704 and covered by the diaphragm, a pressure screw 707, a seal 709 for the nozzle holder 703 and a mounting for the nozzle holder 703.

With the diaphragm flat seat nozzle with nozzle pin 702 (FIG. 14) and without nozzle pin 702 (FIG. 15) shown in FIG. 13, 14 and 15, good fuel atomization at the surface of a domed cone-shaped shell is achieved. The form and dimensions of this cone-shaped shell depend among other things on the dimensions and the design of the outlet in the diaphragm (FIG. 14) and can if necessary be further adapted to engine operation with the known functional advantages by means of an alignment lug or a throttle plug.

The valve operates almost without moving masses and is characterized by a specially designed metal diaphragm mating with a fixed flat valve seat. The diaphragm at the same time valve spring because of the initial tension can be pretensioned against the opening direction (e.g. by arching) by suitable defined and permanent deformation. This way it is possible to improve the fuel atomization at low pressures before the nozzle opening formed by the central perforation in the diaphragm 704, e.g. at low engine speed and small injections (with low part-load operation). The machining of the nozzle hole (rounding of edges etc.) is possible without difficulty from both directions.

To increase the good closing effect at the outward-opening valve of the injection nozzle, the seat ring width of the flat seat (FIG. 14) can be attuned to the initial tension of the diaphragm plate. The right choice of the dimensions of the lower ring recess contributes to this, because this produces the force acting on the diaphragm at the given static pressure of the fuel before the valve seat. On the other side the diaphragm is cooled effectively by the fuel present in the ring recess or flowing through it.

The nozzle does not require lubrication and is therefore particularly suitable for petrol, alcohol and mixture of same. Because of the mode of operation there is no volume downstream of the valve seat comparatively lower engine hydrocarbon emissions can be expected in this nozzle than in nozzles opening inwards.

The nozzle consists of few parts, its manufacture in mass production, maintenance, checking and parts replacement is therefore very simple and economical.

Fuel supply systems for fuel injection devices are flushed with fuel during operation for cooling and evacuation of vapor bubbles. This means that the fuel pump supplies a larger quantity of fuel than the engine requires. This excess is returned to the tank via a line and serves for heat elimination and the evacuation of vapor bubbles. Vapor bubbles result from heat generated during engine operation and can disturb or even prevent the functioning of the injection device. Restarting a still warm engine can also be made more difficult or even impossible by vapor bubbles.

For certain engine applications, e.g. as an outboard engine on boats, a return line to the tank is not permitted by law on safety grounds.

A fuel supply system with an invention-based injection device is therefore designed without a return line to the tank in accordance with a further embodiment of the invention, whereby heat and vapor bubbles can however be eliminated.

The invention solves this problem by using a second fuel pump, a gas separation chamber with float valve and a condenser. This arrangement can be mounted direct on the engine and so avoids pressurized fuel lines outside the engine compartment or the engine enclosure. This meets the legal safety requirements.

An example of this fuel supply device is explained more fully below with the aid of FIG. 16.

A pump 801 draws the fuel 802 from the tank 803 and transfers it through a fuel line 804 to a gas separation chamber 805. The gas separation chamber 805 has a float 806 operating a vent valve 807, which communicates with a gas discharge line 808 arranged in the headroom above the liquid surface 805*a*.

A fuel line 809 branches off from the bottom of the gas separation chamber 805 and this fuel line is connected with a pump 810 and leads to an invention-based injection valve 811 which is connected with the gas separation chamber 805 via a fuel line 812 which leads into the gas separation chamber 805 above the liquid surface 805*a*. A pressure regulator and a condenser are respectively inserted in the fuel line 812 after the injection valve 811.

The new fuel supply device for an invention-based fuel injector functions as follows. The pump 801 suck the fuel 802 from the tank 803 and carries it to the gas separation chamber 805 until the vent valve 807 is closed by the float 806. The pump 810 draws the fuel at the bottom of the gas separation chamber 805 and builds up the pressure required for the particular injection system before the pressure regulator 813. In its delivery characteristic the pump 810 is so designed that it raises the quantity of fuel required for the cooling and flushing of the injection valve 811 and delivers it via the condenser 814 to the gas separation chamber 805. When vapor bubbles 805*b* are carried into the gas separation chamber 805, the fuel level 805*a* falls, the float opens the vent valve 807 until the pump has drawn sufficient additional fuel to restore the original level 805*a*. The vent valve 807 is in communication with the engine air intake 808, so that the fuel vapors exhausted cannot escape unburned into the environment- FIG. 17 shows a preferred circuit for triggering of the rotor excitation coil of the invention-based injection pump which ensures optimum acceleration of the rotor.

It is known how to effect the metering of the fuel to be injected by e.g.-timing. However, a purely time-based control has been found disadvantageous, because the time window between the minimum and maximum fuel quantity to be injected is too small to control the quantity spectrum for engine operation in a sufficiently differentiated and reproducible manner. However, the invention-based pure intensity control of the current flow provides a sufficiently differentiable metering method.

In the case of the electromagnetic drive of the invention-based injection device, the excitation i.e. the product of the number of turns of the coil and the intensity of the current passing through the coil, is of particular importance for the electromagnetic conversion. This means that an exclusive control of the current amplitude makes it possible to select a clearly defined design of the switching performance of the drive magnet, independent of the influence of coil heating and a fluctuating supply voltage. Such a control is particularly responsive to the strongly fluctuating voltage levels and the temperature variations usual in engines.

FIG. 17 shows a two-step control circuit as per the invention for the current amplitude of a current controlling a pump drive coil 600. The drive coil 600 is connected to a power transistor 601 which is grounded through a measuring resistor 602. The output of a comparator 603 is hooked on to the control input of the transistor 601 e.g. to the transistor base. A current setpoint is applied to the non-inverting input of the comparator. This setpoint is e.g. obtained from a microcomputer and the inverting input of the comparator 603 is connected to the transistor 601 on the side of the measuring resistor.

To control the energy flow in the drive coil 600 independently of the supply voltage, the current consumed by the coil 600 is measured by the measuring resistor 602. When this current reaches the limit value given by the microprocessor as setpoint, the transistor switches off the current for the coil 600 via the power transistor 601. As soon as the actual current falls below the current setpoint, the transistor switches the coil current on again via the comparator. The current rise delay caused by the inductivity of the coil 600 prevents that the maximum permissible current is exceeded too rapidly.

After that the next switching cycle can begin and this clocking of the coil current of the coil 600 occurs for as long as the reference voltage supplying the current setpoint prevails at the non-inverting input of the comparator 603.

The circuit represents a clocked power source, whereby the clocking only sets in after reaching the current setpoint supplied by the microprocessor. The energy control and with it the quantity control of the pump device 1 can be carried out with this circuit in combination with the duration and/or intensity of the reference voltage supplied by the microprocessor.

We claim:

1. Fuel injection device operating according to the solid-state energy storage principle, whereby a rotor element (10) contained in a pump housing (8) of an electromagnetically driven reciprocating pump (1) is accelerated virtually without resistance, whereby the rotor element (10) stores kinetic energy and impacts on a piston element (14), so that a pressure impulse is generated in the fuel contained in a sealed pressure chamber (15) before the piston element (14) due to the fact that the stored kinetic energy of the rotor element (10) is transferred via the piston element (14) to the fuel contained in the pressure chamber (15) and whereby the pressure impulse is used for the injection of fuel through an injection device (3), characterized by the fact that the rotor element (10) is carried form-locking on the piston element (1).

2. Fuel injection device as per claim 1, characterized by the fact that the rotor element (10) and the piston element (14) are mutually springmounted.

3. Device as per claim 1, characterized by an electromagnetically driven reciprocating pump (1), connected via a delivery line (2) to an injection device (3), whereby from the delivery line(2) a suction line (4) branches off which is connected with a fuel tank (5).

4. Device as per claim 3, characterized by the fact that the pump (1) has a housing (8) accommodating a toroid coil (9), whereby in the area of the coil passage the rotor element is arranged which is a cylindrical rotor (10) and is carried in a housing cylinder, located in the area of the central longitudinal axis of the toroid coil (9), whereby the rotor 10 is pressed by a pressure spring (12) in an initial position in which it rests against the bosom (11*a*) of the housing cylinder and whereby the rotor (10) cooperates on the injection nozzle side with the piston element designed as delivery plunger (14) which enters a cylindrical fuel delivery space (15) relatively deeply, this delivery space being arranged coaxial with the housing cylinder and in transfer connection with the pressure line (2).

5. Device as per claim 3, characterized by the fact that a non-return valve (16) is arranged in the suction line (4).

6. Device as per claim 3, characterized by the fact that in the delivery line (2) between the injection valve (3) and the pressure chamber before the suction line (4) a non-return valve (16*a*) is arranged which in the space on the injection valve side forms an air chamber for the maintenance of a specific static pressure in the fuel.

7. Device as per claim 4, characterized by the fact that the coil (9) of the pump (1) is connected to a control device (26) which serves as an electronic control for the injection device.

8. Device as per claim 4, characterized by the fact that the rotor (10) has a stepped central longitudinal bore (108*a*) like a blind bore, whereby the final part of the blind bore (108*a*) is of smaller diameter than a central part and forms a stop face (108), whereby in the central part the delivery plunger (14) is carried by an integrated guide ring (105) which has a larger diameter than the delivery plunger (14) and to that extent is adapted to the widened central bore area.

9. Device as per claim 8, the fact that the guide ring (105) of the delivery plunger (14) is under tension from a pressure spring (106) which is relatively weak and is braced with its other end against the bottom of the blind bore area of the bore (108) in the rotor (10).

10. Device as per claim 9, characterized by the fact that in the resting position the guide ring (105) rests with its annular surface against a circular stop face (107) of the central bore part under tension from the spring (106), which stop face is formed as a step between the larger-diameter central bore part and the smaller-diameter bore part with the opening through which passes the delivery plunger (14).

11. Device as per claim 4, characterized by the fact that the rotor has a through-bore (10*a*) traversed by the delivery plunger (14), that a circular stop (14*a*) is attached to the delivery plunger (14) at its free end protruding rearward from the rotor (10), a further stop ring (14*b*) sits in the pressure chamber (15) of the delivery plunger (14), whereby the rotor (10) is arranged between the two stop rings (14*a*) and (14*b*) with an interspace which represents the possible acceleration stroke of the rotor (10).

12. Device as per claim 11, characterized by the fact that the rotor retum spring (12) engages over the stop ring (14*b*).

13. Device as per claim 11, characterized by the fact that the rotor (10) is tensioned at its rear by the return spring (12) which is braced against the bottom (11*a*) of the interior space (11).

14. Device as per claim 13, characterized by the fact that the stop ring (14*b*) has towards the rotor (10) an annular space (14*c*) in which a spring (14*d*)is accommodated, which spring is braced on one side against the rotor (10) and on the other against the bottom of the annular space (14*c*).

15. Fuel injection device operating according to the solid-state energy storage principle, whereby a rotor element (10) contained in a pump housing of an electromagnetically driven reciprocating pump (1) is accelerated virtually without resistance, whereby the rotor element (10) stores kinetic energy and impacts on a piston element (14), so that a pressure impulse is generated in the fuel contained in a sealed pressure chamber before the piston element (14) due to the fact that the stored kinetic energy of the rotor element (1 O) is transferred via the piston element (14) to the fuel contained in the pressure chamber and whereby the pressure impulse is used for the injection of fuel through an injection device (3), characterized by integration of the injection device (3) and the injection pump (1), whereby in a common housing an inner housing cylinder (300) is provided which is divided by a non-magnetic ring element (301) into a section enclosing the injection pump rotor (10), so that a coil (9) can apply a force to the rotor (10).

16. Device as per claim 15, characterized by the fact that the two housing areas of the housing cylinder (300) near the ring element (301) are interconnected hydraulically tight and the coil (9) is positioned on the outer circumference of the housing cylinder (300), whereby the coil engages over the ring element (310) in axial direction.

17. Device as per claim 15 characterized by a cylindrical housing part (302) surrounding the housing cylinder (300) and enclosing the coil (9) from outside.

18. Device as per claim 15, characterized by the fact that on a tank-side end a connecting part (303) which has a through-bore (305) serving as fuel supply line, is screwed in.

19. Device as per claim 15, characterized by the fact that the injection nozzle (3) is screwed into a thread at the pressure-side axial end of the housing cylinder (300).

20. Device as per claim 18, characterized by the fact that there is between the nozzle (3) and the connecting part (303) in the housing cylinder (300) a passage with areas of different diameter, whereby adjacent to the connecting part (303) the passage has its largest diameter which forms the working space (306) for the rotor (10) of the injection pump (1).

21. Device as per claim 20, characterized by the fact that the working space (306) is bounded on the tank side by a circular bottom surface (11*a*) serving as a stop face for the rotor (10) when the rotor is pushed into its resting position by a spring (12), whereby in the bottom surface (11*a*) towards the tank there follows a cross-section increase of the bore (305) accommodating a supply valve (16).

22. Device as per claim 21, characterized by the fact that a through-bore (309) passes through the rotor (10), whereby this through-bore aligns axially with the bore (205) of the connecting part (303), that the rotor has a diameter-reduced area in the pressure-side end part, the rotor return spring (12)is braced at the rotor (10) against the annular face formed in the stepped area between the smallerdiameter area and the larger-diameter area of the rotor (10), at the other end the spring (12) is braced against an annular surface formed in the housing cylinder (300), against a ring projecting inwards (300*a*) between the larger-diameter working space (306) and, following towards the nozzle device (3), the smaller-diameter pressure chamber (11) of the passage of the housing cylinder (300).

23. Device as per claim 22, characterized by the fact that the diameter-reduced end of the rotor (10) is so designed that it can pass through the ring (300*a*).

24. Device as per claim 23, characterized by the fact that the delivery plunger (14) sits in the pressure chamber (11) separate from the rotor (10), is formed as a cylindrical hollow body and has a cylindrical cavity (14*e*) which communicates with the pressure chamber (11) through axial bores (312, 313), whereby in the cavity (14*e*) there is a pressure valve consisting of a valve head (310) and a spring (311) acting on the valve head.

25. Device as per claim 15, characterized by the fact that the injection nozzle (3) is inserted in the front face of the housing cylinder (300) and comprises a screwed-in plug-shaped body (314) with a central through-bore (314*a*) through which passes the push rod (315) of a valve lifter (317) whose tappet head (316) closes the outlet of the bore (314*a*).

26. Device as per claim 25, characterized by the fact that the valve lifter (317) is actuated by a spring (318) braced on one side against an inner circular front surface of the plug (314) and on the other against a spring washer (315*a*) arranged at the inner end of the push rod (317).

27. Device as per claim 26, characterized by the fact that the push rod (315) protrudes into the pressure chamber (11) of the housing cylinder (300) in which the delivery plunger (14) is pushed against the ring (300*a*) by the spring (320) braced against the plug (314), where it rests against a stop face (312) of the ring (300*a*) with its front face mating with the rotor.

28. Device as per claim 25, characterized by the fact that the push rod (315) passes through the bore (313) and protrudes into the interior space (14*e*) of the delivery plunger (14), whereby at the end of the push rod (315) there is a ring (322) which forms a support for the spring (311) of the pressure valve (311, 310).

29. Device as per claim 28, characterized by the fact that peripheral slots (313*a*) are machined in the bore (313).

30. Device as per claim 1, characterized by an auxiliary starting device with a control valve which is connected to an atomizer (506) of the engine and receives fuel from the fuel tank (502) and whose flow resistance together with that of the atomizer (506) is so determined that at starting engine speed with the pressure delivered by a precompression pump (501) the fuel requirement for starting can also be covered without electrical energy supply to the injection device (504).

31. Device as per claim 30, characterized by the fact that after the fuel precompression pump (501) which is connected on the induction side with the fuel tank (502), a branch line of the fuel line to the engine is provided, whereby in the de-energized state an injection device (504) connected to a generator (503) (the injection device being constructed in accordance with the invention and particularly with one of the invention-based embodiments)is inactive and the control valve (505) which may e.g. be electromagnetic, is open for the supply to the atomizer (506) on the engine (500).

32. Device as per claim 31, characterized by the fact that a hand pump (509) on the engine is additionally used during starting for the direct fuel supply to the engine via the atomizer (506) which is arranged in the connection line (511) from the pump (501) to the control valve (505), whereby the control valve (505) is triggered by the injection control (507) via a control line (510).

33. Device as per claim 30, characterized by the fact that the control valve (505) is arranged in the injection line (511) between the injection device (504) and the injection nozzle (508).

34. Device as per claim 33, characterized by a cutout in the line from the injection control (507) to the control valve (505).

35. Device as per claim 33, characterized by the fact that the invention-based auxiliary starting device is used for emergency running, whereby a metering valve (505) effects a fuel quantity variation.

36. Device as per claim 35, characterized by the fact that the metering valve (505) has a housing (520) into which a coil (521) is inserted which serves as a drive of a rotor (522) which is mounted slidable in a bore (523) of the housing (520) and is pushed in its resting position by a return spring (524) against an adjustable stop (525) arranged in the housing (520), while to this stop outside the housing a cable pull is attached, whereby the rotor (522) has peripheral longitudinal slots (527) enabling communication of the fuel in the bore (523) between the front and rear of the rotor (52) and whereby the bulbshaped stop (525) passes through the housing front wall (**520*b*) and in the housing is pretensioned in relation to the housing front wall (520*b*) by a spring (528) and whereby a metering piston (527) is of uniform construction with the front face of the rotor (522) opposite the stop (525) and whereby this front face additionally is under tension from the return spring (524) which is braced at the other end against the front wall (520*a*) of the housing (520) and whereby the metering piston (527) protrudes with a tapering end into the delivery line (511) from which moreover a connection line (511*a*) branches off to the atomizer (506) and whereby the cable pull (526), connected to the stop (525) held by spring force against the rotor (522), is connected to the throttle valve (530**).

37. Device as per claim 1, characterized by a hydraulic damping device for the rotor element (10) of the reciprocating pump.

38. Device as per claim 37, characterized by the fact that the hydraulic damping device is constructed like a piston cylinder arrangement, whereby on the rotor (10) there is a central cylindrical projection (**10*a*) which in the last section of the rotor return movement fits into a blind cylinder bore (11*b*) in the bottom (11*a*) of the cylinder, whereby the rotor (10) has longitudinal slots (10*b***) which connect the space at the rear of the rotor with the space at the front of the rotor in the pump cylinder.

39. Device as per claim 37, characterized by the fact that the pump space (11) traversed by the delivery plunger (14) is connected before the piston (10) with the space (11) adjoining the rear of the rotor by bores (**10*d*) which lead into a central transfer passage (10*c*)in the area at the rear of the rotor, whereby a central pin (8*a*) of a shock absorber (8*b*) protrudes with a cone point (8*c*) towards the opening of the transfer passage (10*c***).

40. Device as per claim 39, characterized by the fact that the central pin (**8*a*) at the rear passes through a hole (8*d*) in the bottom (11*a*) which leads into a damping chamber with a ring (8*f*) which has a larger diameter than the hole (8*d*) and whereby a spring (8*g*) braced against the bottom of the damping chamber, presses against the ring (8*f*) and whereby a passage (8*h*) connects the damping chamber (8*e*) with the rear rotor space (11**).

41. Device as per claim 39, characterized by the fact that in the pin (**8*a*) a displacement through-bore is centrally arranged and through which damping medium can be pressed into the transfer passage (10*c***).

42. Device as per claim 37, characterized by the fact that the rotor (10) during its return movement operates a pump device which simultaneously ensures damping of the rotor (10).

43. Device as per claim 42, characterized by the fact that an oil pump (260) is connected to the rear bottom (**11*a*) of the pump housing (8), which pump has a housing (261) in whose pump space (261*b*) a pump piston (262) is arranged whose piston rod (262*a*) protrudes into the working space (11) of the rotor (10), whereby the piston (262) is under tension from a return spring (263) braced against the housing bottom (261*a*) near an outlet (264**).

44. Device as per claim 43, characterized by the fact that the pump space (**261*b*) communicates via an oil supply line (265) with an oil reservoir (266), whereby a non-return valve (267) is inserted in the oil supply line (265**).

45. Device as per claim 38, characterized by the fact that of the blind cylinder bore (**11*b*) has a larger diameter than the diameter the cylindrical projection (10*a*) and the projection (10*a*) or the blind cylinder bore (11*b*) has a circular sealing lip(10*e*) or (10*d*), whereby the circular sealing lips form the piston seal for the projection (10*a***).

46. Device as per claim 1, characterized by an injection nozzle with a valve seat pipe (701) with a ring channel (708) at the end, a diaphragm plate (704) pretensioned towards the valve seat, the diaphragm plate having a central hole and covering the ring channel (708), if necessary with a plug insert (702) in the hole of the diaphragm (704) a spring ring (705) and a pressure line (706).

47. Device as per claim 1, characterized by a fuel supply device without a return line to the tank, whereby a second fuel pump, a gas separation chamber with float valve and a condenser are used.

48. Device as per claim 47, characterized by a gas separation chamber (805), into which via a line (804) fuel (802)is pumped by a pump (801), out of which line a pump (810) feeds fuel via a fuel line (809) to an injection valve (811), whereby a line (812) is led back from the injection valve (811) into the gas separation chamber (805) where a pressure regulator (813) and a condenser (814) are arranged, whereby in the gas separator (805) a float (806)is provided which operates a vent valve (807) which is installed in a discharge line (808) coming out into the gas separation chamber (805).

49. Device as per claim 48, characterized by the fact that the fuel line (812) comes out into the gas separation chamber (805) above the liquid level (**805*a***).

50. Device as per claim 48, characterized by the fact that the discharge line (808) comes out into the gas separation chamber (805) above the liquid level (**805*a***).

51. Device as per claim 49, characterized by the fact that the fuel line (804) comes out into the gas separation chamber (805) above the liquid level (**805*a***).

52. Device as per claim 48, characterized by the fact that with the exception of a tank (803) all components of the fuel injection system are arranged in the engine compartment (815).

53. Device as per claim 1, characterized by a rotor excitation coil (9,600) operatively associated with the rotor, and a circuit for driving the rotor excitation coil (9,600) which is connected to a power transistor (601) which via a measuring resistor (602) is grounded, whereby a comparator (603) is hooked with its output on to the control input of the transistor (601), e.g. to the transistor base, and whereby a current setpoint is applied to the non-inverting input of the comparator (603), this setpoint being obtained from e.g. a microcomputer and whereby the inverting input of the comparator (603) is connected to the side of the measuring resistor connected with the transistor (601).

* * * * *

UNITED STATES PATENT AND TRADEMARK OFFICE

CERTIFICATE OF CORRECTION

PATENT NO. : 5,520,154

DATED : May 28, 1996

INVENTOR(S) : Wolfgang Heimberg, et al.

It is certified that error appears in the above-identified patent and that said Letters Patent is hereby corrected as shown below:

Col. 14, line 15 (in Claim 1), cancel "form-locking" and insert --with slidably displaceable retention--.

Col. 14, line 16, change reference numeral "1" to --14--.

Column 2, line 27, "call" should read --coil--.

Signed and Sealed this

Eighth Day of October, 1996

*Attest:*

Bruce Lehman

BRUCE LEHMAN

*Attesting Officer*

*Commissioner of Patents and Trademarks*